US008931201B2

(12) United States Patent
Gianladis et al.

(10) Patent No.: US 8,931,201 B2
(45) Date of Patent: Jan. 13, 2015

(54) GUN SUPPORT APPARATUS

(71) Applicant: Battenfield Technologies, Inc., Columbia, MO (US)

(72) Inventors: James Gianladis, Harrisburg, MO (US); Michael Cottrell, Columbia, MO (US); Michael Poehlman, Columbia, MO (US); Adam J. Birk, Hallsville, MO (US); Dennis Cauley, Boonville, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 14/136,702

(22) Filed: Dec. 20, 2013

(65) Prior Publication Data

US 2014/0182184 A1 Jul. 3, 2014

Related U.S. Application Data

(60) Provisional application No. 61/747,636, filed on Dec. 31, 2012.

(51) Int. Cl.
*F41A 23/18* (2006.01)

(52) U.S. Cl.
CPC ..... *F41A 23/18* (2013.01)
USPC ..... 42/94

(58) Field of Classification Search
CPC ..... F41A 23/18
USPC ..... 42/94; 73/167; 89/37.04
See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |

(Continued)

FOREIGN PATENT DOCUMENTS

| | | |
|---|---|---|
| DE | 838872 | 5/1952 |
| EP | 0624455 | 11/1994 |
| GB | 475080 | 11/1937 |

OTHER PUBLICATIONS

Joe's, "Shooter's Ridge Steady Point Shooting Rest," http://www.joessports.com/product/index.jsp?productId=3155005&cp=726872&parentPag . . . , Item No. 3155005, 1 pg. [Internet accessed Jul. 17, 2008].

(Continued)

*Primary Examiner* — Reginald Tillman, Jr.
(74) *Attorney, Agent, or Firm* — Senniger Powers LLP

(57) ABSTRACT

Gun support apparatus for supporting a gun or components of a gun for assembly, servicing, cleaning, or other gunsmithing operations. A vise may include one or more gun supports for supporting a gun. A gun support may include a magazine well insert receivable in a magazine well of a gun. The support may be pivotable and may include a hammer stop. A gun support may include a channel of tapering width which is pivotable for positioning a desired width of the channel for receiving a portion of a gun to be supported in the channel. A bolt support device may be used to mount a bolt for cleaning or servicing.

16 Claims, 16 Drawing Sheets

(56) References Cited

U.S. PATENT DOCUMENTS

| | | | |
|---|---|---|---|
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,187,325 | A | 6/1916 | Ivey |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |
| 1,499,748 | A | 5/1922 | Papouchis |
| 1,457,407 | A | 6/1923 | Stokes |
| 1,488,647 | A | 4/1924 | Quinn |
| 1,491,604 | A | 4/1924 | Fuller |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,427,365 | A | 3/1944 | Meister |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,582,140 | A | 1/1952 | Leek |
| 2,638,676 | A | 5/1953 | Callahan |
| 2,677,207 | A | 5/1954 | Stewart |
| 2,701,930 | A | 2/1955 | Dolan |
| 2,729,975 | A | 1/1956 | Hawthornet et al. |
| 2,731,829 | A | 1/1956 | Wigington et al. |
| 2,740,530 | A | 4/1956 | Ponder |
| 2,753,642 | A | 7/1956 | Sullivan |
| 2,774,090 | A | 12/1956 | Allinson |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,874,707 | A | 2/1959 | Koppel |
| 2,877,689 | A | 3/1959 | Pribis |
| 2,894,347 | A | 7/1959 | Woodcock |
| 3,064,976 | A | 11/1959 | Kuhn |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,013,289 | A | 12/1961 | Sasena |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,107,642 | A | 10/1963 | Lakin |
| 3,112,567 | A | 12/1963 | Flanagan |
| 3,125,929 | A | 3/1964 | Peasley |
| 3,128,668 | A | 4/1964 | Dicken |
| 3,137,957 | A | 6/1964 | Ingalls |
| 3,163,420 | A | 12/1964 | Braun |
| 3,175,456 | A | 3/1965 | Goodsell |
| 3,183,617 | A | 5/1965 | Ruger et al. |
| 3,205,518 | A | 9/1965 | Romaine |
| 3,206,885 | A | 9/1965 | Dye |
| 3,225,656 | A | 12/1965 | Flaherty et al. |
| D203,680 | S | 2/1966 | Allison |
| 3,240,103 | A | 3/1966 | Lamont |
| 3,259,986 | A | 7/1966 | Carr |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,358,504 | A | 12/1967 | Freebairn |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,473,673 | A | 10/1969 | Porter |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,536,160 | A | 10/1970 | Brewer |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,609,902 | A | 10/1971 | Casull |
| 3,646,704 | A | 3/1972 | Ellsworth |
| 3,648,909 | A | 3/1972 | Wisecarver |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,736,243 | A | 5/1973 | Duggan |
| 3,738,101 | A | 6/1973 | Simon-Vermot |
| 3,739,515 | A | 6/1973 | Koon, Jr. |
| 3,743,088 | A | 7/1973 | Henkin |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,771,176 | A | 11/1973 | Herman, Sr. |
| 3,804,238 | A | 4/1974 | Howard |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,876,078 | A | 4/1975 | Gomes et al. |
| 3,877,178 | A | 4/1975 | Campanelli |
| 3,878,939 | A | 4/1975 | Wilcox |

(56) References Cited

U.S. PATENT DOCUMENTS

| | | | |
|---|---|---|---|
| 3,885,357 | A | 5/1975 | Hoyt |
| 3,893,266 | A | 7/1975 | Anderson et al. |
| 3,895,803 | A | 7/1975 | Loe |
| 3,899,175 | A | 8/1975 | Loe |
| 3,899,797 | A | 8/1975 | Gunst |
| D237,106 | S | 10/1975 | Baljet et al. |
| 3,913,746 | A | 10/1975 | Burton |
| 3,914,879 | A | 10/1975 | Taylor, III et al. |
| 3,935,657 | A | 2/1976 | Wade |
| 3,947,988 | A | 4/1976 | Besaw |
| 3,949,987 | A | 4/1976 | Candor |
| 3,961,436 | A | 6/1976 | Hagen et al. |
| 3,964,613 | A | 6/1976 | Anderson, Jr. |
| 3,979,849 | A | 9/1976 | Haskins |
| 4,007,554 | A | 2/1977 | Helmstadter |
| 4,012,860 | A | 3/1977 | Auger |
| 4,018,339 | A | 4/1977 | Pritz |
| 4,021,971 | A | 5/1977 | McFadden |
| 4,026,057 | A | 5/1977 | Cady |
| 4,027,781 | A | 6/1977 | Covert |
| 4,042,242 | A | 8/1977 | Nicholls et al. |
| 4,054,288 | A | 10/1977 | Perrine, Sr. |
| 4,055,016 | A | 10/1977 | Katsenes |
| 4,072,313 | A | 2/1978 | Murso et al. |
| 4,076,247 | A | 2/1978 | Kim et al. |
| 4,090,606 | A | 5/1978 | Dawson |
| 4,120,108 | A | 10/1978 | Vickers et al. |
| 4,120,276 | A | 10/1978 | Curran |
| 4,122,623 | A | 10/1978 | Stice |
| 4,143,491 | A | 3/1979 | Blanc |
| 4,177,608 | A | 12/1979 | Balz |
| 4,188,855 | A | 2/1980 | Alberts |
| 4,203,600 | A | 5/1980 | Brown |
| 4,206,573 | A | 6/1980 | Hayward |
| 4,207,699 | A | 6/1980 | Hensley |
| 4,222,305 | A | 9/1980 | Lee |
| 4,223,588 | A | 9/1980 | Simpson |
| 4,233,748 | A | 11/1980 | Ford et al. |
| D257,687 | S | 12/1980 | Bechtel |
| 4,265,045 | A | 5/1981 | Garbini |
| 4,266,748 | A | 5/1981 | Dalton |
| 4,266,780 | A | 5/1981 | McQuary |
| 4,282,671 | A | 8/1981 | Wood et al. |
| D260,650 | S | 9/1981 | Alviti |
| D261,794 | S | 11/1981 | Bechtel |
| 4,301,625 | A | 11/1981 | Rampe |
| 4,312,146 | A | 1/1982 | Koon, Jr. et al. |
| 4,332,185 | A | 6/1982 | Hargrove |
| 4,333,385 | A | 6/1982 | Culver |
| 4,338,726 | A | 7/1982 | Swailes |
| 4,340,370 | A | 7/1982 | Marshall et al. |
| 4,345,398 | A | 8/1982 | Pickett |
| 4,346,530 | A | 8/1982 | Stewart et al. |
| 4,359,833 | A | 11/1982 | Pachmayr et al. |
| 4,361,989 | A | 12/1982 | Ohno |
| 4,385,464 | A | 5/1983 | Casull |
| 4,385,545 | A | 5/1983 | Duer |
| 4,391,058 | A | 7/1983 | Casull |
| 4,392,321 | A | 7/1983 | Bosworth |
| 4,407,379 | A | 10/1983 | Pryor et al. |
| 4,409,751 | A | 10/1983 | Goda et al. |
| 4,409,826 | A | 10/1983 | Wenger |
| 4,426,085 | A | 1/1984 | Dixon |
| 4,438,913 | A | 3/1984 | Hylla |
| 4,446,900 | A | 5/1984 | Markovich |
| 4,449,314 | A | 5/1984 | Sorensen |
| 4,462,598 | A | 7/1984 | Chalin et al. |
| 4,477,082 | A | 10/1984 | McKenzie et al. |
| 4,480,411 | A | 11/1984 | Balz et al. |
| 4,506,466 | A | 3/1985 | Hall |
| 4,508,508 | A | 4/1985 | Theodore |
| 4,512,101 | A | 4/1985 | Waterman, Jr. |
| 4,522,102 | A | 6/1985 | Pickens |
| 4,526,084 | A | 7/1985 | David et al. |
| 4,540,182 | A | 9/1985 | Clement |
| 4,542,677 | A | 9/1985 | Lee |
| 4,548,392 | A | 10/1985 | Rickling |
| 4,558,531 | A | 12/1985 | Kilby |
| D283,561 | S | 4/1986 | Geist et al. |
| 4,601,124 | A | 7/1986 | Brown, Jr. |
| 4,608,762 | A | 9/1986 | Varner |
| 4,621,563 | A | 11/1986 | Poiencot |
| 4,625,620 | A | 12/1986 | Harris |
| 4,632,008 | A | 12/1986 | Homer |
| 4,644,987 | A | 2/1987 | Kiang et al. |
| 4,648,191 | A | 3/1987 | Goff et al. |
| 4,653,210 | A | 3/1987 | Poff, Jr. |
| 4,671,364 | A | 6/1987 | Fink et al. |
| 4,674,216 | A | 6/1987 | Ruger et al. |
| 4,695,060 | A | 9/1987 | Pilgrim |
| 4,696,356 | A | 9/1987 | Ellion et al. |
| 4,702,029 | A | 10/1987 | DeVaul et al. |
| 4,715,476 | A | 12/1987 | France |
| 4,715,499 | A | 12/1987 | Franklin |
| 4,716,673 | A | 1/1988 | Williams et al. |
| 4,721,205 | A | 1/1988 | Burt et al. |
| 4,723,472 | A | 2/1988 | Lee |
| 4,729,186 | A | 3/1988 | Rieger |
| 4,732,394 | A | 3/1988 | Stein et al. |
| 4,736,843 | A | 4/1988 | Leonard |
| 4,739,996 | A | 4/1988 | Vedder |
| 4,751,963 | A | 6/1988 | Bui et al. |
| D297,855 | S | 9/1988 | Ruger et al. |
| 4,776,471 | A | 10/1988 | Elkins |
| 4,790,079 | A | 12/1988 | Meyers |
| 4,790,096 | A | 12/1988 | Gibson et al. |
| 4,799,324 | A | 1/1989 | Nodo |
| 4,807,381 | A | 2/1989 | Southard |
| 4,807,888 | A | 2/1989 | Pidde et al. |
| 4,815,593 | A | 3/1989 | Brown |
| 4,819,359 | A | 4/1989 | Bassett |
| 4,821,422 | A | 4/1989 | Porter |
| 4,821,443 | A | 4/1989 | Bianco et al. |
| 4,823,673 | A | 4/1989 | Downing |
| 4,824,086 | A | 4/1989 | Rickling et al. |
| 4,841,839 | A | 6/1989 | Stuart |
| 4,850,151 | A | 7/1989 | Ditscherlein |
| 4,854,066 | A | 8/1989 | Canterbury, Sr. |
| 4,862,567 | A | 9/1989 | Beebe |
| D304,223 | S | 10/1989 | Ruger et al. |
| 4,873,777 | A | 10/1989 | Southard |
| 4,877,131 | A | 10/1989 | Patros et al. |
| 4,890,406 | A | 1/1990 | French |
| 4,890,847 | A | 1/1990 | Cartee et al. |
| 4,896,446 | A | 1/1990 | Gregory |
| D306,234 | S | 2/1990 | Ferstl et al. |
| 4,903,425 | A | 2/1990 | Harris |
| 4,910,904 | A | 3/1990 | Rose |
| 4,918,825 | A | 4/1990 | Lesh et al. |
| 4,921,256 | A | 5/1990 | Gearhart |
| 4,923,402 | A | 5/1990 | Marshall et al. |
| 4,924,616 | A | 5/1990 | Bell et al. |
| 4,937,965 | A | 7/1990 | Narvaez |
| D310,302 | S | 9/1990 | Southard |
| 4,967,497 | A | 11/1990 | Yakscoe |
| 4,971,208 | A | 11/1990 | Reinfried, Jr. et al. |
| 4,972,619 | A | 11/1990 | Eckert |
| 4,979,752 | A | 12/1990 | Fosseen |
| D313,886 | S | 1/1991 | Southard |
| 4,987,694 | A | 1/1991 | Lombardo |
| 4,998,367 | A | 3/1991 | Leibowitz |
| 4,998,944 | A | 3/1991 | Lund |
| 5,005,657 | A | 4/1991 | Ellion et al. |
| 5,009,021 | A | 4/1991 | Nelson |
| 5,014,793 | A | 5/1991 | Germanton et al. |
| 5,031,348 | A | 7/1991 | Carey |
| 5,050,330 | A | 9/1991 | Pilgrim et al. |
| 5,058,302 | A | 10/1991 | Minneman |
| 5,060,410 | A | 10/1991 | Mueller |
| 5,063,679 | A | 11/1991 | Schwandt |
| 5,067,268 | A | 11/1991 | Ransom |
| 5,070,636 | A | 12/1991 | Mueller |
| 5,074,188 | A | 12/1991 | Harris |
| 5,081,783 | A | 1/1992 | Jarvis |

(56) References Cited

U.S. PATENT DOCUMENTS

| | | | |
|---|---|---|---|
| 5,117,850 | A | 6/1992 | Money |
| 5,123,194 | A | 6/1992 | Mason |
| 5,125,389 | A | 6/1992 | Paff |
| 5,143,340 | A | 9/1992 | Wood et al. |
| 5,149,900 | A | 9/1992 | Buck |
| 5,173,563 | A | 12/1992 | Gray |
| 5,180,874 | A | 1/1993 | Troncoso, Jr |
| 5,185,927 | A | 2/1993 | Rivers |
| 5,186,468 | A | 2/1993 | Davies |
| 5,188,371 | A | 2/1993 | Edwards |
| 5,194,678 | A | 3/1993 | Kramer |
| D335,896 | S | 5/1993 | Evenson |
| 5,211,404 | A | 5/1993 | Grant |
| 5,221,806 | A | 6/1993 | Chaney et al. |
| 5,222,306 | A | 6/1993 | Neumann |
| 5,228,887 | A | 7/1993 | Mayer et al. |
| 5,232,227 | A | 8/1993 | Bateman |
| 5,233,779 | A | 8/1993 | Shaw |
| 5,235,764 | A | 8/1993 | Perazzi |
| 5,237,778 | A | 8/1993 | Baer |
| 5,240,258 | A | 8/1993 | Bateman |
| 5,247,758 | A | 9/1993 | Mason |
| 5,271,175 | A | 12/1993 | West, III |
| 5,275,890 | A | 1/1994 | Wolf et al. |
| 5,287,643 | A | 2/1994 | Arizpe-Gilmore |
| 5,311,693 | A | 5/1994 | Underwood |
| 5,315,781 | A | 5/1994 | Beisner |
| 5,316,579 | A | 5/1994 | McMillan et al. |
| 5,320,217 | A | 6/1994 | Lenarz |
| 5,320,223 | A | 6/1994 | Allen |
| 5,328,029 | A | 7/1994 | Chow et al. |
| 5,332,185 | A | 7/1994 | Walker, III |
| 5,333,829 | A | 8/1994 | Bell et al. |
| 5,335,578 | A | 8/1994 | Lorden et al. |
| 5,337,505 | A | 8/1994 | Brown et al. |
| 5,344,012 | A | 9/1994 | Matthews |
| 5,347,740 | A | 9/1994 | Rather et al. |
| 5,351,428 | A | 10/1994 | Graham |
| 5,354,247 | A | 10/1994 | Wilkinson |
| 5,358,254 | A | 10/1994 | Yeh et al. |
| 5,361,505 | A | 11/1994 | Faughn |
| 5,367,232 | A | 11/1994 | Netherton et al. |
| 5,370,240 | A | 12/1994 | Hand |
| 5,375,377 | A | 12/1994 | Kenton |
| 5,392,553 | A | 2/1995 | Carey |
| 5,394,983 | A | 3/1995 | Latulippe et al. |
| 5,402,595 | A | 4/1995 | Tamllos |
| 5,406,733 | A | 4/1995 | Tarlton et al. |
| 5,410,833 | A | 5/1995 | Paterson |
| 5,414,949 | A | 5/1995 | Peebles |
| D359,392 | S | 6/1995 | Bellington |
| 5,421,115 | A | 6/1995 | McKay |
| 5,433,010 | A | 7/1995 | Bell |
| 5,433,451 | A | 7/1995 | DeVries |
| 5,435,223 | A | 7/1995 | Blodgett et al. |
| 5,442,860 | A | 8/1995 | Palmer |
| D362,116 | S | 9/1995 | Bellington et al. |
| 5,446,987 | A | 9/1995 | Lee et al. |
| D364,080 | S | 11/1995 | Weyrauch |
| 5,481,817 | A | 1/1996 | Parker |
| 5,482,241 | A | 1/1996 | Oglesby |
| 5,486,135 | A | 1/1996 | Arpaio |
| 5,490,302 | A | 2/1996 | Dion |
| 5,491,921 | A | 2/1996 | Allen |
| 5,497,557 | A | 3/1996 | Martinsson et al. |
| 5,497,575 | A | 3/1996 | Fried et al. |
| 5,501,467 | A | 3/1996 | Kandel |
| D369,904 | S | 5/1996 | Taylor |
| 5,525,314 | A | 6/1996 | Hurson |
| 5,540,329 | A | 7/1996 | Vogeley |
| 5,545,855 | A | 8/1996 | Stanfield et al. |
| 5,562,208 | A | 10/1996 | Hasler et al. |
| D375,538 | S | 11/1996 | Minneman |
| 5,570,513 | A | 11/1996 | Peterson |
| 5,580,063 | A | 12/1996 | Edwards |
| 5,588,242 | A | 12/1996 | Hughes |
| 5,600,913 | A | 2/1997 | Minneman |
| 5,617,666 | A | 4/1997 | Scott |
| 5,622,344 | A | 4/1997 | Gracie |
| 5,628,135 | A | 5/1997 | Cady |
| D380,116 | S | 6/1997 | Minneman |
| 5,640,944 | A | 6/1997 | Minneman |
| 5,644,862 | A | 7/1997 | Folmer |
| 5,649,465 | A | 7/1997 | Beebe |
| 5,651,207 | A | 7/1997 | Knight |
| 5,653,625 | A | 8/1997 | Pierce et al. |
| 5,661,919 | A | 9/1997 | Pryor |
| 5,662,516 | A | 9/1997 | You |
| 5,666,757 | A | 9/1997 | Helmstadter |
| D387,123 | S | 12/1997 | Hughes et al. |
| 5,703,317 | A | 12/1997 | Levilly et al. |
| 5,704,482 | A | 1/1998 | Apps et al. |
| 5,711,102 | A | 1/1998 | Plaster et al. |
| 5,711,103 | A | 1/1998 | Keng |
| 5,715,625 | A | 2/1998 | West, III |
| D391,616 | S | 3/1998 | Plybon |
| 5,723,183 | A | 3/1998 | Williams et al. |
| 5,723,806 | A | 3/1998 | Odom |
| 5,725,096 | A | 3/1998 | Winnard |
| 5,737,865 | A | 4/1998 | Brandl et al. |
| 5,740,625 | A | 4/1998 | Jenkins |
| 5,743,395 | A | 4/1998 | Backer |
| 5,758,447 | A | 6/1998 | Venetz |
| 5,758,933 | A | 6/1998 | Clendening |
| 5,761,954 | A | 6/1998 | Dvorak |
| 5,778,589 | A | 7/1998 | Teague |
| 5,779,527 | A | 7/1998 | Maebashi |
| 5,791,499 | A | 8/1998 | Zebbedies |
| 5,811,720 | A | 9/1998 | Quinnell et al. |
| 5,815,974 | A | 10/1998 | Keng |
| 5,833,308 | A | 11/1998 | Strong, III et al. |
| D403,176 | S | 12/1998 | Harper |
| 5,845,774 | A | 12/1998 | Hausknecht |
| 5,857,279 | A | 1/1999 | de Oliveira Masina et al. |
| 5,875,580 | A | 3/1999 | Hill et al. |
| 5,878,504 | A | 3/1999 | Harms |
| 5,884,966 | A | 3/1999 | Hill et al. |
| 5,899,329 | A | 5/1999 | Hu et al. |
| 5,907,919 | A | 6/1999 | Keeney |
| 5,913,131 | A | 6/1999 | Hossain et al. |
| 5,913,422 | A | 6/1999 | Cote et al. |
| 5,913,667 | A | 6/1999 | Smilee |
| 5,913,668 | A | 6/1999 | Messer |
| 5,924,694 | A | 7/1999 | Kent |
| 5,930,932 | A | 8/1999 | Peterson |
| 5,933,997 | A | 8/1999 | Barrett |
| 5,933,999 | A | 8/1999 | McClure et al. |
| 5,937,561 | A | 8/1999 | Abernethy |
| 5,959,613 | A | 9/1999 | Rosenbreg et al. |
| 5,970,642 | A | 10/1999 | Martin |
| 5,974,719 | A | 11/1999 | Simonek |
| 6,019,375 | A | 2/2000 | West, Jr. |
| 6,021,891 | A | 2/2000 | Anderson |
| 6,032,796 | A | 3/2000 | Hopper et al. |
| 6,042,080 | A | 3/2000 | Shepherd et al. |
| 6,044,747 | A | 4/2000 | Felts |
| 6,058,641 | A | 5/2000 | Vecqueray |
| 6,073,381 | A | 6/2000 | Farrar et al. |
| 6,086,375 | A | 7/2000 | Legros |
| 6,092,662 | A | 7/2000 | Frederick, Jr. et al. |
| 6,110,020 | A | 8/2000 | Rolfi |
| 6,121,556 | A | 9/2000 | Cole |
| 6,237,462 | B1 | 5/2001 | Hawkes et al. |
| 6,254,100 | B1 | 7/2001 | Rinehart |
| 6,260,463 | B1 | 7/2001 | Brand et al. |
| 6,269,578 | B1 | 8/2001 | Callegari |
| 6,283,428 | B1 | 9/2001 | Maples et al. |
| 6,289,622 | B1 | 9/2001 | Desch, Jr. et al. |
| 6,293,041 | B2 | 9/2001 | Weaver |
| 6,294,759 | B1 | 9/2001 | Dunn, Jr. |
| 6,305,117 | B1 | 10/2001 | Hales, Sr. |
| 6,309,476 | B1 | 10/2001 | Ravenscroft et al. |
| 6,338,218 | B1 | 1/2002 | Hegler |
| 6,390,294 | B1 | 5/2002 | Fiore et al. |

(56) References Cited

U.S. PATENT DOCUMENTS

| | | | |
|---|---|---|---|
| 6,397,720 | B1 | 6/2002 | Fox et al. |
| 6,439,515 | B1 | 8/2002 | Powers |
| 6,439,530 | B1 | 8/2002 | Schoenfish et al. |
| 6,517,133 | B2 | 2/2003 | Seegmiller et al. |
| D471,248 | S | 3/2003 | Jacobs |
| 6,526,687 | B1 | 3/2003 | Looney |
| D473,376 | S | 4/2003 | Abate |
| 6,546,662 | B1 | 4/2003 | Chong |
| 6,557,855 | B2 | 5/2003 | Wu |
| 6,574,899 | B1 | 6/2003 | Mostello |
| 6,575,469 | B2 | 6/2003 | Lowe |
| 6,643,973 | B1 | 11/2003 | Smith |
| 6,663,298 | B2 | 12/2003 | Haney |
| 6,688,031 | B2 | 2/2004 | Steele |
| 6,733,375 | B2 | 5/2004 | Hoffman |
| 6,736,400 | B1 | 5/2004 | Cesternino |
| 6,813,855 | B2 | 11/2004 | Pinkley |
| 6,814,654 | B2 | 11/2004 | Rolfi |
| 6,854,975 | B2 | 2/2005 | Ranzinger |
| 6,860,054 | B1 | 3/2005 | Mosher |
| 6,860,055 | B1 | 3/2005 | Walrath |
| 6,862,833 | B1 | 3/2005 | Gutner |
| 6,871,440 | B2 | 3/2005 | Highfill et al. |
| 6,877,266 | B1 | 4/2005 | Brownlee |
| 6,883,263 | B1 | 4/2005 | Carrow |
| 6,931,777 | B1 | 8/2005 | Krien |
| 6,953,114 | B2 | 10/2005 | Wang et al. |
| D513,055 | S | 12/2005 | Lahti |
| 6,978,569 | B2 | 12/2005 | Williamson, IV et al. |
| D519,183 | S | 4/2006 | Minneman |
| 7,032,494 | B2 | 4/2006 | Wygant |
| D521,100 | S | 5/2006 | Morrow |
| 7,043,862 | B2 | 5/2006 | Franks |
| 7,055,279 | B2 | 6/2006 | Flores |
| 7,062,979 | B2 | 6/2006 | Day et al. |
| D524,541 | S | 7/2006 | Cauley |
| 7,086,192 | B2 | 8/2006 | Deros |
| 7,104,398 | B1 | 9/2006 | Wisecarver |
| 7,134,663 | B1 | 11/2006 | Lowe et al. |
| 7,143,986 | B1 | 12/2006 | Austin et al. |
| 7,152,355 | B2 | 12/2006 | Fitzpatrick et al. |
| 7,152,358 | B1 | 12/2006 | LeAnna et al. |
| 7,159,711 | B1 | 1/2007 | Gardner |
| 7,165,750 | B2 | 1/2007 | McCuskey et al. |
| 7,188,445 | B2 | 3/2007 | Lehman |
| D540,904 | S | 4/2007 | Werner |
| 7,200,966 | B2 | 4/2007 | Gooder |
| 7,201,376 | B2 | 4/2007 | Kuosa |
| 7,207,567 | B1 | 4/2007 | Brown |
| D543,604 | S | 5/2007 | Minneman |
| 7,213,494 | B2 | 5/2007 | James |
| 7,216,404 | B1 | 5/2007 | Doyle |
| 7,222,451 | B2 | 5/2007 | Keng et al. |
| 7,225,050 | B2 | 5/2007 | Sutula, Jr. |
| 7,246,704 | B2 | 7/2007 | Brunson et al. |
| 7,258,345 | B2 | 8/2007 | Anderson, Jr. |
| D553,219 | S | 10/2007 | Potterfield |
| 7,281,346 | B1 | 10/2007 | Cook et al. |
| D567,895 | S | 4/2008 | Cauley |
| 7,356,960 | B1 | 4/2008 | Knitt |
| 7,356,961 | B2 | 4/2008 | Williams |
| 7,357,250 | B2 | 4/2008 | Hagemann |
| 7,363,740 | B2 | 4/2008 | Kincel |
| 7,367,451 | B2 | 5/2008 | Pendergraph et al. |
| 7,401,431 | B2 | 7/2008 | Pierce et al. |
| 7,410,053 | B2 | 8/2008 | Bowen et al. |
| D576,245 | S | 9/2008 | Potterfield et al. |
| 7,421,815 | B1 | 9/2008 | Moody et al. |
| 7,426,800 | B2 | 9/2008 | Pierce et al. |
| 7,431,247 | B2 | 10/2008 | Bobro |
| 7,481,015 | B2 | 1/2009 | Mays |
| 7,536,819 | B2 | 5/2009 | Popikow |
| 7,536,820 | B2 | 5/2009 | Wade et al. |
| 7,549,247 | B1 | 6/2009 | Reese |
| 7,584,690 | B2 | 9/2009 | Cauley |
| D605,246 | S | 12/2009 | Hobbs |
| 7,631,455 | B2 | 12/2009 | Keng et al. |
| 7,631,877 | B2 | 12/2009 | Zara |
| 7,654,498 | B1 | 2/2010 | Beltz |
| 7,658,140 | B2 | 2/2010 | Lombardi |
| 7,665,241 | B2 | 2/2010 | Oz |
| 7,676,977 | B1 | 3/2010 | Cahill et al. |
| 7,681,886 | B2 | 3/2010 | Morrow et al. |
| 7,694,973 | B1 | 4/2010 | Hofmeister |
| 7,713,180 | B2 | 5/2010 | Wickens et al. |
| 7,726,478 | B2 | 6/2010 | Potterfield et al. |
| 7,730,824 | B1 | 6/2010 | Black |
| 7,743,544 | B2 | 6/2010 | Laney et al. |
| 7,774,972 | B2 | 8/2010 | Potterfield et al. |
| 7,779,572 | B2 | 8/2010 | Potterfield et al. |
| 7,823,317 | B2 | 11/2010 | Potterfield et al. |
| 7,845,267 | B2 | 12/2010 | Potterfield et al. |
| 7,866,081 | B2 | 1/2011 | Seuk |
| 7,883,396 | B2 | 2/2011 | Potterfield et al. |
| 7,954,272 | B2 | 6/2011 | Potterfield et al. |
| 7,997,021 | B2 | 8/2011 | Cauley |
| 8,011,129 | B2 | 9/2011 | Cauley et al. |
| 8,104,212 | B2 | 1/2012 | Potterfield et al. |
| 8,296,988 | B2 | 10/2012 | Yale et al. |
| 8,336,708 | B2 | 12/2012 | Potterfield et al. |
| 8,371,057 | B2 | 2/2013 | Coffield et al. |
| 8,444,056 | B2 | 5/2013 | Gamez et al. |
| 8,496,212 | B2 | 7/2013 | Keng et al. |
| 2002/0195752 | A1 | 12/2002 | Yang |
| 2003/0234205 | A1 | 12/2003 | McGuyer et al. |
| 2004/0112777 | A1 | 6/2004 | Huang |
| 2004/0134113 | A1 | 7/2004 | Deros et al. |
| 2005/0115137 | A1 | 6/2005 | Minneman |
| 2006/0065560 | A1 | 3/2006 | Dickinson et al. |
| 2006/0175213 | A1 | 8/2006 | Hurt et al. |
| 2006/0254111 | A1 | 11/2006 | Giauque et al. |
| 2006/0277811 | A1 | 12/2006 | Peterson |
| 2007/0051028 | A1 | 3/2007 | Stordal |
| 2007/0068379 | A1 | 3/2007 | Sween et al. |
| 2007/0068835 | A1 | 3/2007 | Buie, III |
| 2007/0094911 | A1 | 5/2007 | Rush et al. |
| 2007/0113460 | A1 | 5/2007 | Potterfield et al. |
| 2007/0256346 | A1 | 11/2007 | Potterfield et al. |
| 2007/0295197 | A1 | 12/2007 | Potterfield |
| 2008/0023379 | A1 | 1/2008 | Potterfield et al. |
| 2008/0054570 | A1 | 3/2008 | Potterfield et al. |
| 2008/0061509 | A1 | 3/2008 | Potterfield |
| 2008/0128002 | A1 | 6/2008 | Jeffs |
| 2008/0156671 | A1 | 7/2008 | Jansson |
| 2008/0174071 | A1 | 7/2008 | Potterfield et al. |
| 2008/0263928 | A1 | 10/2008 | Potterfield |
| 2009/0126250 | A1 | 5/2009 | Keng |
| 2009/0188146 | A1 | 7/2009 | Werner |
| 2010/0102178 | A1 | 4/2010 | Smith et al. |
| 2010/0126055 | A1 | 5/2010 | Potterfield |
| 2010/0138032 | A1 | 6/2010 | Potterfield |
| 2010/0236125 | A1 | 9/2010 | Morrow et al. |
| 2010/0270201 | A1 | 10/2010 | Cauley et al. |
| 2011/0024985 | A1 | 2/2011 | Potterfield et al. |
| 2011/0036214 | A1 | 2/2011 | Potterfield |
| 2011/0094140 | A1 | 4/2011 | Letson |
| 2012/0175844 | A1 | 7/2012 | Potterfield |

OTHER PUBLICATIONS

Lahti Company Brochure, "Rifle Evaluator: No Pain, No Fear, No Flinching, No Body Movement," www.lahticompany.com, 2 pgs., Undated.

Lahti Company, Evaluator Brochure, http://www.lathicompany.com/Forms/EvaluatorBrochure2.jpg, 2 pgs., accessed Jan. 16, 2006.

MacksPW.com, "Desert Mountain Bench Master Rifle Rest," http://www.macksqw.com/Item-i-DESBM1, © 2004-2008, 1 pg. [Internet accessed Jul. 22, 2008].

Midway USA, "Shooters Ridge Steady Point Rifle Shooting Rest," http://www.midwayusa.com/eproductpage.exe/showproduct?saleitemid=826745&t=11082005, 2005, 5 pgs. [Internet accessed on Aug. 6, 2008].

Midway USA. "Tipton Range Box with Ultimate Rifle, Handgun Cleaning Kit (No Solvents)". <URL: http://www.midwayusa.com/

(56) References Cited

OTHER PUBLICATIONS rewriteaproducU135086>. 2 pgs. The date on which the Tipton Range Box was first on sale is not known, but is believed to be circa 2004.
MidwayUSA, "ADG Rifle Shooting Rest," http://www.midwayusa.com/eproductpage.exe/showproduct?saleitemid=992071 &t=11082005, 2005, 3 pgs. [Internet accessed on Aug. 6, 2008].
MidwayUSA, "Caldwell Full Length Fire Control Shooting Rest," http://www.midwayusa.com/eproductpage.exe/ showproduct?saleitemid=683866&t=11082005, 2005, 3 pgs. [Internet accessed on Aug. 6, 2008].
MidwayUSA, "Caldwell Lead Sled DFT Rifle Shooting Rest," http://www.midwayusa.com/eproductpage.exe/ showproduct?saleitemid=149023&t=11082005, 2005, 6 pgs. [Internet accessed on Aug. 6, 2008].
MidwayUSA, "Caldwell Lead Sled Rifle Shooting Rest," http://www.midwayusa.com/eproductpage.exe/ showproduct?saleitemid=152664&t=11082005, 2005, 8 pgs. [Internet accessed on Aug. 6, 2008].
MidwayUSA, "Caldwell Steady Rest NXT Rifle Shooting Rest," http://www.midwayusa.com/eproductpage.exe/ showproduct?saleitemid=838651&t=11082005, 2005, 4 pgs. [Internet accessed on Aug. 6, 2008].
MidwayUSA, "Caldwell Zero-Max Rifle Shooting Rest," http://www.midwayusa.com/eproductpage.exe/ showproduct?saleitemid=726222&t=11082005, 2005, 3 pgs. [Internet accessed on Aug. 6, 2008].
MidwayUSA, "CTK Precision P3 Ultimate Shooting Rest," http://www.midwayusa.com/eproductpage.exe/ showproduct?saleitemid=114699&t=11082005, 2005, 2 pgs. [Internet accessed on Aug. 6, 2008.
MidwayUSA, "Hyskore® dangerous Game Rifle Shooting Rest," http://www.midwayusa.com/eproductpage.exe/ showproduct?saleitemid=729197&t=11082005, 2005, 3 pgs. [Internet accessed on Aug. 6, 2008].
MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 3 pgs. [Internet accessed on Aug. 6, 2008].
MidwayUSA, "Hyskore® Swivel Varmint Rifle Shooting Rest," http://www.midwayusa.com/eproductpage.exe/ showproduct?saleitemid=587606&t=11082005,2005, 3 pgs. [Internet accessed on Aug. 6, 2008].
MidwayUSA, "Shooters Ridge Steady Point Rifle Shooting Rest with Vise," http://www.midwayusa.com/eproductpage.exe/ showproduct?saleitemid=341095&t=11082005, D 2005, 4 pgs. [Internet accessed on Aug. 6, 2008].
MidwayUSA, "Shooting Supplies—Shop Everything for Your Firearm at MidwayUSA," http://www.midwayusa.com/browse/BrowseProducts.aspx?categoryStrin . . . , 15 pgs. [Internet accessed on Jul. 21, 2008].
MidwayUSA, "Stoney Point Bench Anchor Rifle Shooting Rest," http://www.midwayusa.com/eproductpage.exe/ showproduct?saleitemid=347174&t=11082005, 2005, 2 pgs. [Internet accessed on Aug. 6, 2008].
Milek, B., "Handloading for Hunting" New Products from RCBS, Lee, Accurate Arms, Peterson's Hunting, Mar. 1985, p. 21. 1 pg.
Millett, "BenchMaster Shooting Rests," 1 pg. Undated.
MTM Case-Gard. "Gun Maintenance Centers." 2 pgs. The date on which the MTM Gun Maintenance Center was first on sale is not known, but is believed to be circa 2004.
MTM Case-Gard. "Rifle rest and pistol shooting rest". <URL: http://www.mtmcasegard.corn/products/shooting/shoo.html>. 3 pgs. The date on which the MTM Site-In-Clean was first on sale is not known, but is believed to be circa 2004.
MTM Shoulder-Gard Rifle Rest, MTM Case-Gard, p. 2 "Rests", 1 pg.
Precision Shooting, Inc., Bald Eagle Front Rest, The Accurate Rifle, vol. 6, Issue No. 4, May 2003, p. 47. 1 pg.
Protektor Model, "The Original Leather Rifle and Pistol Rest," http://www.protektormodel.com/, 12 pgs. [Internet accessed on Feb. 14, 2006].
Shooters Ridge, "Deluxe Rifle Rest," http://www.shootersridge.com, 1 pg. [Internet accessed Jul. 21, 2008].
Shooters Ridge, "Shooting Rest with Gun Vise," http://www.shootersridge.com, 1 pg. [Internet accessed Jul. 17, 2008].
Sinclair International, Sinclair Shooting Rests, Products for the Precision Shooter, 2002, Issue No. 2002-B, pp. 76-78.
Sweeney, P "Gunsmithing: Measure Headspace," Peterson's Rifleshooter, http://www.rifleshootermag.com/gunsmithing/headspace__0612/, 4 pgs. [Internet Accessed Dec. 11, 2004].
Tenex Precision Co. "Recoil A-Rest-R" Product Pictures, 4 sheets, Riverside CA.
The Sportsman's Guide. "Plano Shooters Case!" <URL: http://www.sportsmansguide.com/cb/cb.asp?a=148225>. 3 pgs. The date on which the Plano Shooters Case was first on sale is not known, but is believed to be circa 2004.
Cabela's, "Sharp Shooter Rifle Rest," http://www.cabelas.com/cabelas/en/templates/links/link.jsp?id=0005816222738a &type=product&cmCat=, © 1996-2008, 2 pgs. [Internet accessed on Aug. 6, 2008].
"Impact Guns,""Promag AR-15/M16 Lower Receiver Magazine Well Vise Block,""2 pgs. [Internet Accessed Nov. 19, 2012]".
Masterhang, "Masterhang I Jeep Door Hanger," 2 pgs. [Internet Accessed Nov. 19, 2012].
Sinclair International, "Sinclair AR-15 Bolt Vise," 2 pgs., admitted prior art.
"American Rifleman: What to do about recoil," LookSmart, http ://www.findarticles.com/p/articles/mi__qa3623/is__199907/ai__n886159/print, pp. 1-4, accessed Jan. 4, 2006.
"Cleaning Cradles: Sinclaire Cleaning Cradles" p. 21. 1 pg. The date on which the Sinclair Folding Cleaning Cradle was first on sale is not known, but is believed to be circa 2004.
"Decker Rifle Vise", 1 pg. The date on which the Decker Rifle Vise was first on sale is not known, but is believed to be circa 2004.
"The Grabber and Hustler '76," MEC—Mayville Engineering Company, Inc., 2 pgs., undated.
"Uncle Bud's Bull Bags," http:www.unclebudscss.com/pages/Bulls%20bags.html, 2 pgs. [Internet accessed on Feb. 14, 2006].
"Uncle Bud's Udder Bag," http:www.unclebudscss.com/pages/Udder%20Bags.html, 2 pgs. [Internet accessed on Feb. 14, 2006].
1Shop2.com. "Hoppe's Gunsmith's Fully Adjustable Bench Vise", 3 pgs. The date on which the Hoppe's Gunsmith's Fully Adjustable Bench Vise was first on sale is not known, but is believed to be circa 2004.
AcuSport Outdoor Sporting Products, 3 pgs.
Amazon.com, "CTK® P3 Ultimate Shooting Rest," Sports & Outdoors, http://www.amazon.com/CTK%C2%AE-P3-Uitimate-Shooting-Rest/dp/ . . . , 1 pg. [Internet accessed on Jul. 22, 2008].
Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin . . . , 1 pg. [Internet accessed on Jul. 22, 2008].
Amazon.com, "Stoney Point Adjustable Shooting Rest w/Bag," Sports & Outdoors, http://www.amazon.com/Stoney-Point-Adjustable-Shooting-Rest/dp/BO . . . , 1 pg. [Internet accessed on Jul. 22, 2008].
Basspro.com, "Bass Pro Shops Outdoors Online: Offering the best in Fishing, Hunting and Outdoor Products," http://www.basspro.com/webapp/wcs/stores/servlet/Product 10151 -1 10001 95064 SearchResults, 2 pgs. [Internet accessed on Aug. 6, 2008].
Battenfeld Technologies, Inc., "Gun Vise," Tipton Gun Cleaning Supplies, Battenfeld Technologies, Inc. 2004 Catalog, p. 32, Product No. 782-731, 2 pgs.
Battenfeld Technologies, Inc., "Steady Rest Portable Shooting Rest," file://C:\DOCUME-1\DUTCD\LOCALS-1\Temp\PQ28V28J.htm, 1 pg., accessed Jan. 25, 2006.
Big Boy Gun Toys, "Shooting Rest," http://www.bigboyguntoys.com/shootingrest.htm, 1 pg. [Internet accessed on Jul. 18, 2008].

(56) References Cited

OTHER PUBLICATIONS

Boyt Harness Company, Product Catalog, http://www.boytharness.com/catalog/index.php?cPath=22, 2 pgs. [Internet accessed on Jul. 21, 2008].
Brownells, Inc., Catalog No. 41, 1988-1989, 3 pgs.
Brownells, Inc., Catalog No. 57, 2004-2005, 2 pgs.
Brownells, Inc., Catalog No. 47, 1994-1995, 2 pgs.
Brownells, Inc., Sight Base Cutters, Faxed Dec. 17, 2003, 1 pg.
Cabela's Hunting Fishing and Outdoor Gear Master Catalog, Fall2002, Edition II, Minimizer Rifle Rest, Item No. SC-22/4332 and SC-22-4333, p. 492.
Cabela's: World's Foremost Outfitter. "HySkore Sighting System and Cleaning Vise". 1 pg. The date on which the HySkore Sighting System and Cleaning Vise was first on sale is not known, but is believed to be circa Jan. 2005. However, a prototype of this product may have been shown to buyers at Cabela's circa Aug. 2004.
Cabela's. "Master Catalog Fall 2003: Late-Season Edition". Cover page and p. 416. 2 pgs.
Cabela's, "BenchBuddy® Gun Rest," http://www.cabelas.com/cabelas/en/templates/links/link.jsp?id=0005819221954a &type=product&cmCat=, © 1996-2008, 2 pgs. [Internet accessed on Aug. 6, 2008].
Cabela's, "Elite Rifle Rest," http://www.cabelas.com/cabelas/en/templates/links/link.jsp?id=0005817227855a&type=product &cmCat=, © 1996-2008, 2 pgs. [Internet accessed on Aug. 6, 2008].
Cabela's, "Hyskore® Dangerous Game™ Machine Rest," http://www.cabelas.com/cabelas/en/templates/links/link.jsp?id=0044091228566a&type=product&cmCat=, © 1996-2008, 2 pgs. [Internet accessed on Aug. 6, 2008].
Cabela's, "Hyskore® Ultimate Sighting Rest," http://www.cabelas.com/cabelas/en/templates/links/link.jsp?id=0024152226083a &type=product&cmCat=, © 1996-2008, 2 pgs. [Internet accessed on Aug. 6, 2008].
Cabela's, "Nitro Shoulder Shield Rest," http://www.cabelas.com/cabelas/en/templates/links/link.jsp?id=0040862228231a &type=product&cmCat=, © 1996-2008, 2 pgs. [Internet accessed on Aug. 6, 2008].
Cabela's, "Premier Rifle Rest," http://www.cabelas.com/cabelas/en/templates/links/link.jsp?id=0020904227856a&type=product &cmCat= . . . , © 1996-2008, 2 pgs. [Internet accessed on Aug. 6, 2008].
Cabela's, "Secure Bench Rest," http://www.cabelas.com/cabelas/en/templates/links/link.jsp;jsessionid=4F0LP0OW2HMRLLAOBBISCOF . . . , © 1996-2008, 2 pgs. [Internet accessed on Aug. 6, 2008].
Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pgs. [Internet accessed on Aug. 6, 2008].
Cabela's, "Shooting Benches & Portable Rifle Shooting Bench Rest," http://www.cabelas.com/ssubcat-1/cat20793.shtml, 3 pgs. [Internet accessed Jul. 18, 2008].
Cabela's, "Sure Shot Shooting Vise/Rest," http://www.cabelas.com/cabelas/en/templates/product/standard-item.jsp?id=00348272277 . . . , © 1996-2008, 2 pgs. [Internet accessed on Jul. 15, 2008].
Caldwell Shooting Supplies, 2006 Catalog, pp. 18, 5, 12, 14 and 15. 5 pgs.
Californiavarmintcallers.com—Forum, http://californiavarmintcallers.com/community/modules/newbb/viewtopic.php?topic_id=10 &forum=9&PHPSESSID=074ed8c7 . . . pp. 1-4 accessed Jan. 16, 2006.
Canadian Camo, "Gun Rest," https://media5.magma.ca/www.canadiancamo.com/catalog/product_info.php?products_id= . . . , 2 pgs. [Internet accessed on Feb. 13, 2006].
Champion Traps & Target, 2005 Product Catalog, 12 pgs.
CTK Precision, "P3 Ultimate Shooting Rest," http://www.ctkprecision.com/index.asp?PageAction=VIEWPROD&ProdOID=2, 3 pgs. [Internet accessed on Jul. 18, 2008].
CTK Precision, All Products, http://www.ctkprecision.com/index.asp?PageAction=VI EWCATS&Cate . . . , 3 pgs. [Internet accessed on Jul. 22, 2008].
CV-500, 3 pgs. [product photos].
E. Arthur Brown Company, "A Shooting Rest that Really Works . . . ," http://www.eabco.comfTargetShooting01.html, © 2007-2008, 1 pg. [Internet accessed Jul. 18, 2008].
Edgewood Shooting Bags Catalog, http://www.edgebag.com/catalog.php, 7 pgs. [Internet accessed on Feb. 14, 2006].
Ellett Brothers, Rests & Gun Vises, 3 pgs.
Four photos of the Lohman Sight Vise. 4 pgs. The date on which the Lohman Sight Vise was first on sale is not known, but is believed to be circa 2004.
Grafix® Plastics, http://www.grafixplastics.com/plastic_film_g.asp?gclid=CK-5-7gnY4CFRVNhQodjFhfSQ, 29 pgs. [Internet accessed on Aug. 30, 2007].
"Gun Rest-Shooting Rest-Rifle Rests," http://www.exploreproducts.com/gunrests-shootingrests.htm, 6 pgs. [Internet accessed Jul. 18, 2008].
Hyskore, "Rest—Dangerous Game Machine Rest," Hyskore Rest, Professional firearm rests, http://www.hyskore.com/rests.htm, 2 pgs. [Internet accessed Jul. 21, 2008].
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].

GUN SUPPORT APPARATUS

CROSS-REFERENCE TO RELATED APPLICATIONS

This application claims priority to U.S. Provisional Patent Application No. 61/747,636, filed Dec. 31, 2012, which is hereby incorporated by reference in its entirety.

FIELD OF THE INVENTION

The present disclosure generally relates to supports for guns or components of guns, and more particularly to a gun vise, a support receivable in a magazine well of a gun, a support including a support channel, and a bolt support device.

BACKGROUND OF THE INVENTION

It may be desirable to support a gun or components of a gun in various positions for tasks involving the gun including assembly, servicing, cleaning or other gunsmithing tasks. The present invention is directed to apparatus configured for supporting a gun and/or components of a gun.

SUMMARY

In one aspect, the present invention includes a vise for a gun including at least one of a magazine well, a barrel assembly, a hammer, and a bolt. The vise includes a platform and a first gun support connected to the platform. The gun support includes a magazine well insert member receivable in the magazine well of the gun for supporting the gun. The magazine well insert member is connected to the platform via a pivot connection for selective pivoting movement of the insert member with respect to the platform for supporting the gun on the magazine well insert member in a desired position.

In another aspect, the present invention includes a support for a gun including at least one of a magazine well, a hammer, and a bolt. The support includes a base adapted for mounting to a support surface and a magazine well insert member receivable in the magazine well of the gun for supporting the gun. A pivot connection pivotally connects the magazine well insert member to the base for permitting selective pivoting movement of the insert member with respect to the base about the pivot connection.

In another aspect, the present invention includes a support for a gun including a magazine well and a hammer. The support includes a base adapted for mounting to a support surface and a magazine well insert member connected to the base. The magazine well insert member includes a body receivable in the magazine well of the gun for supporting the gun. The magazine well insert includes a hammer stop.

In yet another aspect, the present invention includes a bolt support device for supporting a bolt of a gun. The bolt includes at least one of a longitudinal axis, a bolt face including an ejector supported by an ejector spring, a main body, and a plurality of lugs extending outward from the main body and having ends opposite the bolt face. The bolt support device includes a bolt face engagement surface adapted for engaging the bolt face. The bolt support device also includes a lug end engagement surface opposing the bolt end engagement surface. The lug end engagement surface is adapted for engaging the end of the lug opposite the bolt face. The bolt face engagement surface has a predetermined fixed position with respect to the lug end engagement surface.

In yet another aspect, the present invention includes a support for a gun. The support includes a base and a support channel connected to the base via a pivot connection. The support channel has a first width adjacent a first end of the support channel and a second width adjacent a second end of the support channel which is less than the first width. The support channel includes a spine having a concave side. The pivot connection is positioned on the concave side of the spine such that pivoting of the support channel about the pivot connection moves the first and second widths of the support channel to selected radial positions with respect to the pivot connection.

Other objects and features of the present invention will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
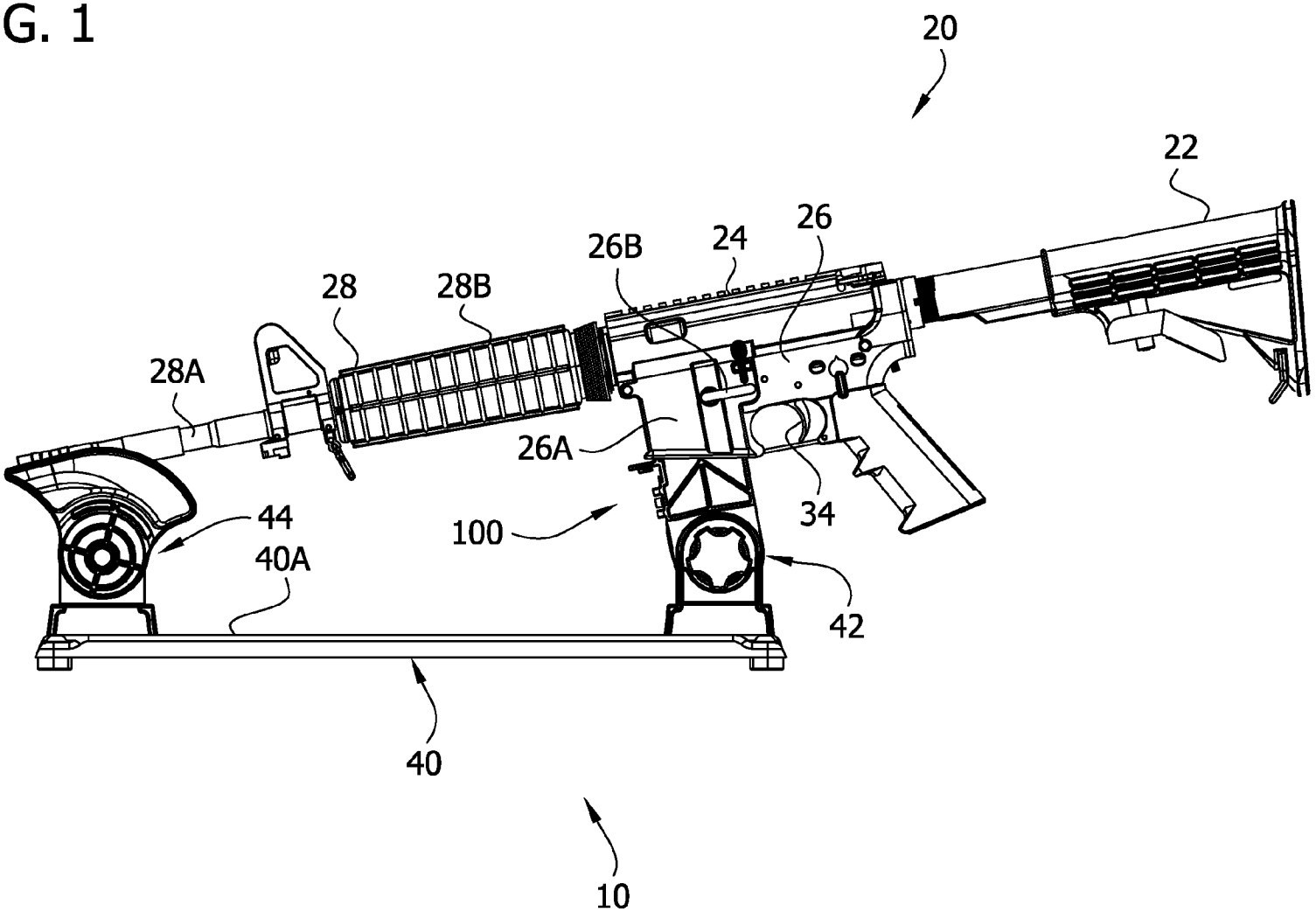
FIG. 1 is a front elevation of a gun supported on a gun vise according to the present invention including first and second gun supports.

Referring to FIG. 1, a gun vise of the present invention is designated generally by the reference number 10. As will become apparent, the gun vise 10 may be used for supporting a gun in various positions. For example, the vise may be used for supporting a gun in a desired position for assembling, servicing, or cleaning the gun or for other gunsmithing operations.

The term "gun" as used herein refers to one or more parts of a gun. The term may be used to refer to a single part of a gun, a partially assembled gun, or a fully assembled gun. It will be appreciated a gun may be supported in various states of assembly during gunsmithing operations, and apparatus according to the present invention may be used for supporting a fully assembled gun, a partially assembled gun, or one or more parts of a gun, without departing from the scope of the present invention.

In the illustrated embodiment, an AR-15 rifle is shown mounted on the vise and is generally indicated by the reference number 20. The rifle includes a variety of components, such as a buttstock 22, an upper receiver 24, a lower receiver 26, and a barrel assembly 28. The lower receiver includes a magazine well 26A configured for receiving a magazine of ammunition (not shown). The magazine well 26A has a generally rectangular cross section and includes a retainer 26B adapted for engaging the magazine for retaining the magazine in the magazine well. The magazine well 26A passes through the lower receiver 26 from a bottom side of the lower receiver to an upper side of the lower receiver such that ammunition from the magazine may be fed to a firing mechanism in the upper receiver. The firing mechanism includes a bolt 30 (see FIG. 8). A hammer 32 is operatively connected to a trigger 34 and is mounted in the lower receiver 26 (see FIG. 3). The barrel assembly 28 includes a barrel 28A and handguard or forend 28B. The AR-15 rifle 20 is illustrated by example without limitation. It will be understood that gun support apparatus of the present invention may be used for supporting other types of guns without departing from the scope of the present invention.

The vise 10 includes a platform 40 and first and second gun supports 42, 44 mounted on the platform for supporting the gun 20. The platform 40 includes a generally rectangular tray-shaped body 40A. The platform 40 serves as a mounting structure for the first and second supports 42, 44. Other configurations of platforms may be used without departing from the scope of the present invention. In the illustrated embodiment, both supports 42, 44 are shown supporting the gun 20. It will be understood that the vise 10 may include other numbers of supports (e.g., one, three, four, or more supports) and one or more of the supports of the vise may be used to support the gun, without departing from the scope of the present invention.

The components of the vise 10 may be formed of any suitable material, including but not limited to metal, polymer, and/or other types of material. For example, the platform 20 may be formed of a metal material or rigid solvent-resistant polymer material. In the illustrated embodiment, the first and second supports 42, 44 are shown as including molded polymer components. Desirably, components of the supports are sufficiently rigid for supporting the gun in a secure and stable manner.

Figure 2:
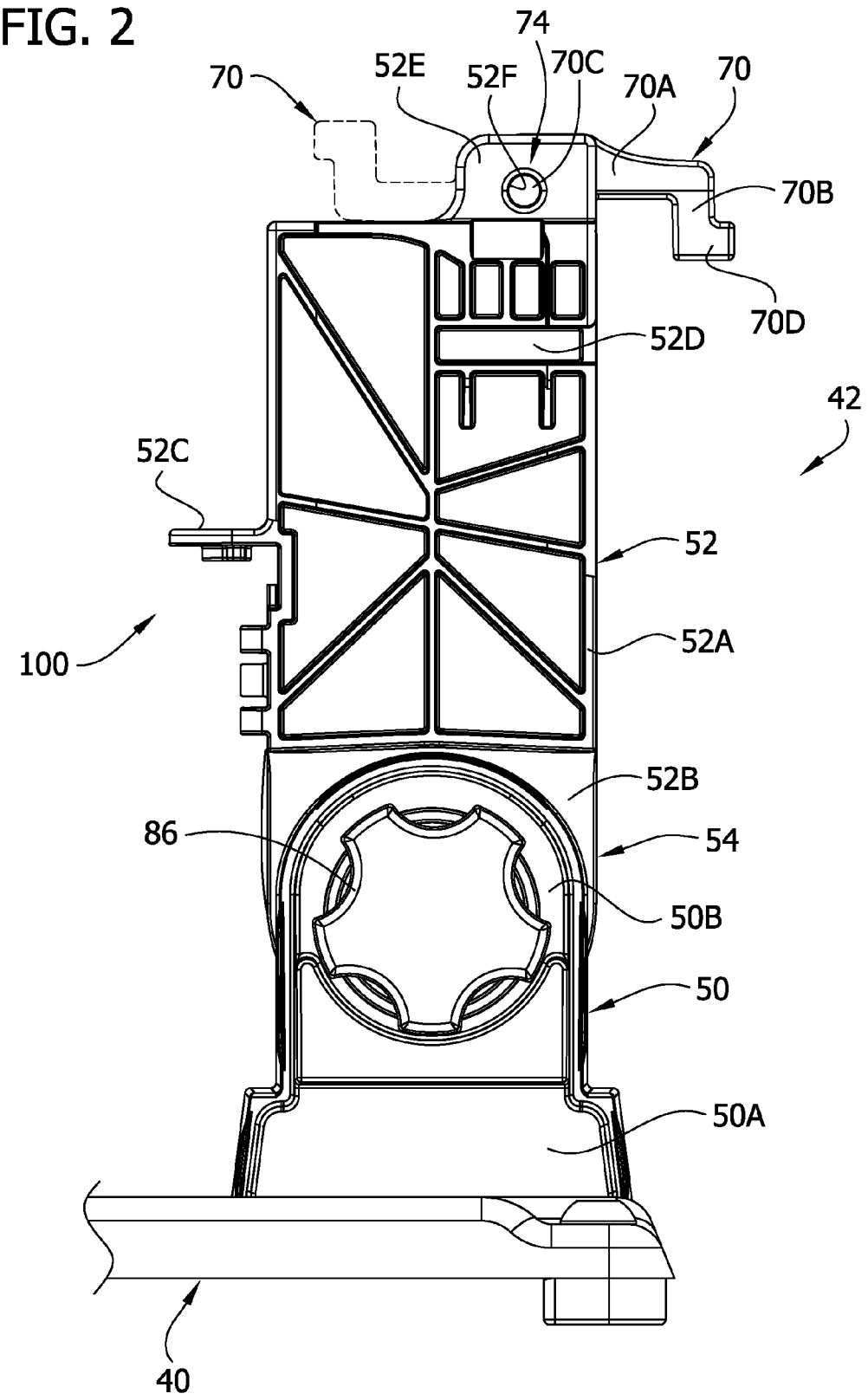
FIG. 2 is an enlarged, fragmentary front elevation of the gun vise of FIG. 1 with the gun removed and having the first gun support.
Figure 3:
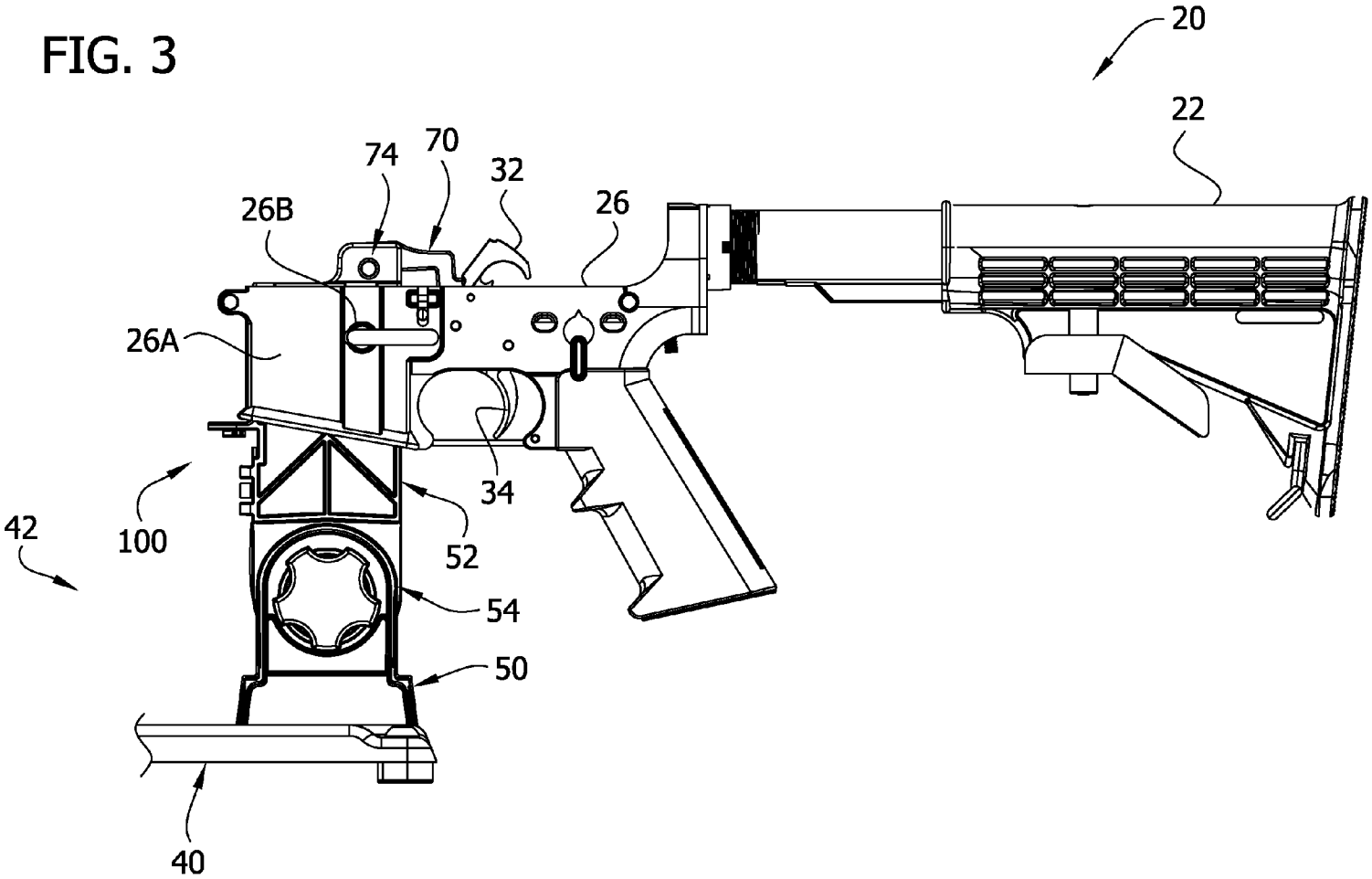
FIG. 3 is the front elevation of FIG. 2 on a reduced scale and showing a lower receiver of the gun mounted on a magazine well insert member and a hammer stop in engagement with a hammer of the gun.

Referring to FIGS. 2 and 3, the first support 42 is adapted for supporting the gun 20 by connection with the magazine well 26A. The support 42 includes a base 50 and a magazine well insert member 52. The magazine well insert member 52 is connected to the base 50 by a pivot connection 54. The base 50 includes a body 50A having a lower end which may be mounted on the platform 40 in a suitable fashion. For example, the base 50 may be connected to the platform 40 by fasteners such as bolts, screws, clips, clamps, and the like, which may be receivable into the lower end of the body. The fasteners may permit releasable fastening of the base 50 to the platform 40 for mounting the support 42 on the platform in various positions as desired. For example, the base may be mounted at various positions along the length of the platform. Moreover, the base 50 may be fixed to the platform 40 (e.g., formed as one piece with the platform). The base 50 includes a head or pivot connection member 50B positioned at an upper end of the body 50A. As will become apparent, the pivot connection member 50B is adapted for forming the pivot connection 54 with the magazine well insert member 52.

The magazine well insert member 52 includes a generally rectangular body 52A having a proximal end, a distal end, and a length and longitudinal axis extending between the proximal and distal ends. The magazine well insert member 52 includes a pivot connection member 52B extending from the proximal end of the body 52A for forming the pivot connection 54 with the base 50. As shown in FIG. 2, the body 52A includes front and back sides (facing into and out of the page, respectively) and left and right sides (facing to the left and to the right, respectively). The front and back sides are wider than the left and right sides. The perimeter of the cross section of the body 52A corresponds to the generally rectangular cross section of the magazine well 26A of the gun 20. In use, the distal end of the magazine well insert member 52 is inserted into the magazine well 26A. Desirably, the body 52A has a size and shape adapted for forming a relatively tight fit of the body in the magazine well 26A. It will be appreciated that such a fit enhances the sturdiness of support provided by the first support 52. In the illustrated embodiment, the body 52A and pivot connection member 52B comprise molded polymeric material including reinforcing ribs and hollow portions in the front and back sides of the body. A solid body or other constructions may be used without departing from the scope of the present invention.

The magazine well insert member 52 includes a magazine well rest 52C and a retainer recess 52D for enhancing a connection of the magazine well insert member to the magazine well 26A. When the insert member 52 is received in the magazine well 26A, the magazine well rest 52C provides a bearing surface for the magazine well, and the retainer recess 52D is engaged by the magazine retainer 26B of the gun 20. The magazine well rest 52C is positioned for engaging a lower end of the magazine well 26A when the main body 52A is inserted in the magazine well. The magazine well rest 52C supports the magazine well 26A and thus the gun 20 at a predetermined height with respect to the insert member 52A. In the illustrated embodiment, the magazine well rest 52C comprises a tab extending outward from the left side of the body 52A. The retainer recess 52D is provided in the front side of the body 52A and is positioned and adapted for receiving the magazine retainer 26B of the gun 20. Reception of the magazine retainer 26B in the retainer recess 52D prevents the main body 52A from being removed from the magazine well 26A much like it prevents a magazine from being removed from the magazine well. Actuation of the retainer 26B displaces it from operative engagement with the retainer recess 52D to permit the gun 20 to be removed from the first support 52 like a magazine may be removed from the magazine well 26A.

The first support 42 includes a hammer stop 70 adapted for engaging the hammer 32 of the gun 20. As shown in FIG. 2, the hammer stop 70 is selectively movable from a stowed position (e.g., indicated in phantom lines) to a deployed position (e.g., indicated in solid lines). The hammer stop 70 is shown in the deployed position and in engagement with the hammer 32 in FIG. 3. Desirably, the hammer stop 70 prevents the hammer 32 from striking the lower receiver 26 or the body 52A of the magazine well insert member 52. This may be used as a safety feature for inadvertent firing of the hammer 32 or for intentional dry firing. For example, in a gunsmithing operation, the hammer 32 may be repeatedly dry fired, and the hammer stop 70 may be used to cushion and safely stop travel of the hammer.

Referring again to FIG. 2, the hammer stop 70 includes a generally L-shaped body including a neck 70A (broadly "first portion") and a head 70B (broadly "second portion"). The hammer stop 70 is connected to the body 52A of the magazine well insert member 52 by a pivot connection 74 which permits pivoting movement of the hammer stop between the stowed and deployed positions. More specifically, a proximal end of the neck 70A is pivotally connected to a distal end of the body 52A of the magazine well insert member 52. Ears 52E extending upward on opposite front and back sides of the body 52A of the magazine well insert member 52 include sockets in the form of circular openings 52F which receive respective pivot pins 70C of the hammer stop 70 which extend outward from opposite sides of the proximal end of the neck 70A. The neck 70A has a length and longitudinal axis extending between the pivot connection 74 and the head 70B. The head 70B has a longitudinal axis which extends laterally with respect to the longitudinal axis of the neck 70A. In other words, the longitudinal axis of the head 70B diverges from or is perpendicular to the longitudinal axis of the neck 70A. In the illustrated embodiment, the longitudinal axis of the head 70B forms an angle of about 90 degrees with respect to the longitudinal axis of the neck 70A. The head 70B includes a nose 70D on a distal end of the head that extends laterally with respect to the longitudinal axis of the head. The nose 70D is positioned offset from the longitudinal axis of the neck 70A. The configuration of the head 70B with respect to the neck 70A and the nose 70D of the head has been found to be particularly useful in preventing displacement of the hammer stop 70 from its deployed position (i.e., inadvertent pivoting of the hammer stop) upon repeated firing of the hammer 32. Engagement of the hammer 32 with the nose 70D desirably tends to pivot the hammer stop 70 toward its deployed position rather than its stowed position.

In use, the hammer stop 70 may be in its stowed position for inserting the magazine well insert member 52 into the magazine well 26A. In the stowed position, the hammer stop 70 lies within the projection of the rectangular cross sectional perimeter of the body 52A of the insert member 52 and thus does not interfere with insertion of the body into the magazine well 26A. Once the insert member 52 is inserted in the magazine well 26A, the hammer stop 70 may be pivoted about the pivot connection 74 for positioning the head 70B of the hammer stop 70 into position for engaging the hammer 32. Desirably, the hammer stop 70 is formed of resilient and/or compressible material such as a type of rubber or polymeric material. This type of material may be better suited for cushioning the blow of the hammer 32 compared to a relatively rigid material (e.g., rigid polymer) which may be used to form the body of the magazine well insert member. Other configurations of hammer stops and other materials may be used without departing from the present invention. In one non-limiting embodiment, the nose 70D may be omitted.

Figure 4A:
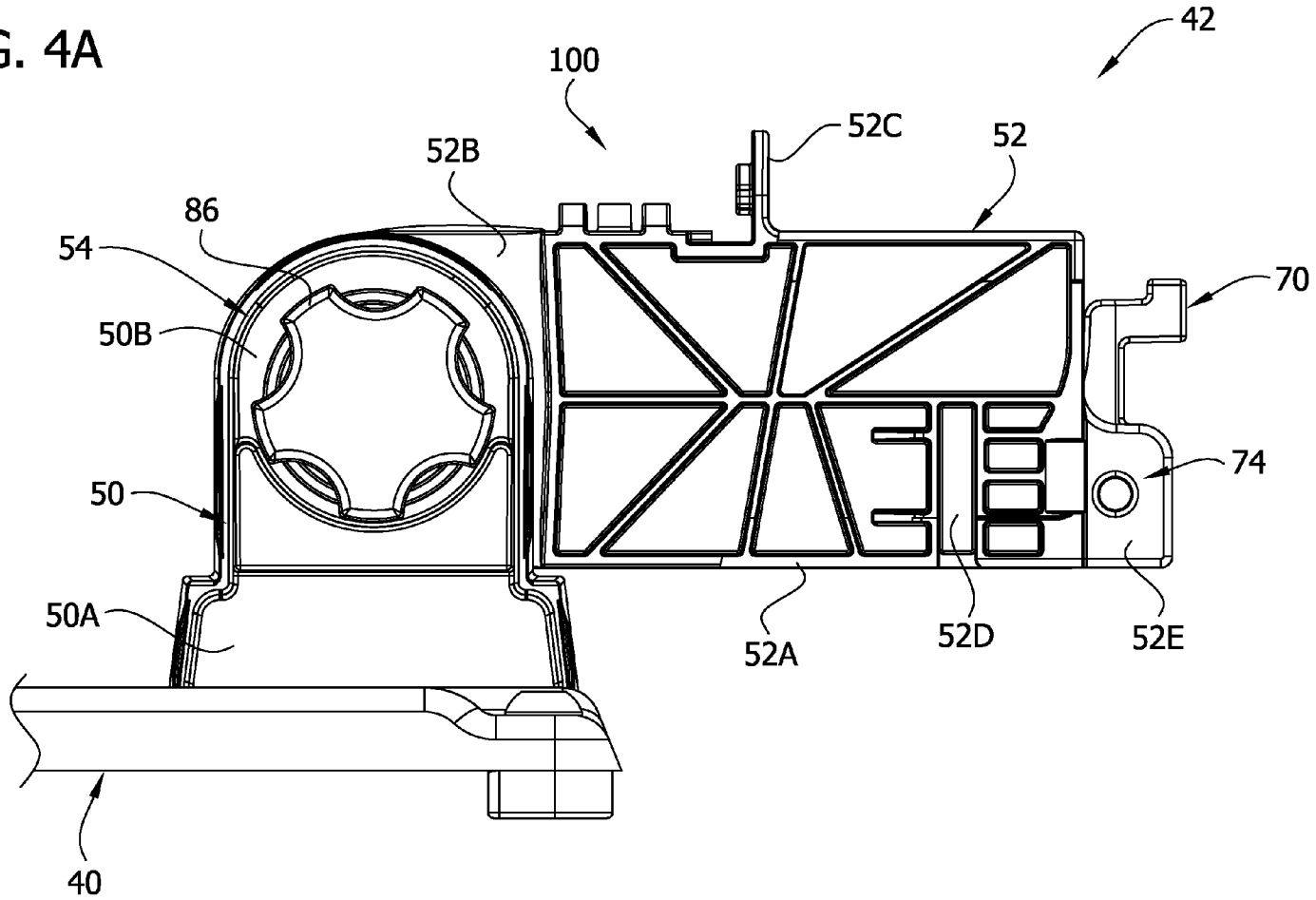
FIG. 4A is a front elevation view similar to FIG. 2 but showing the magazine well insert member being pivoted to a different position with respect to a base of the first gun support.
Figure 4B:
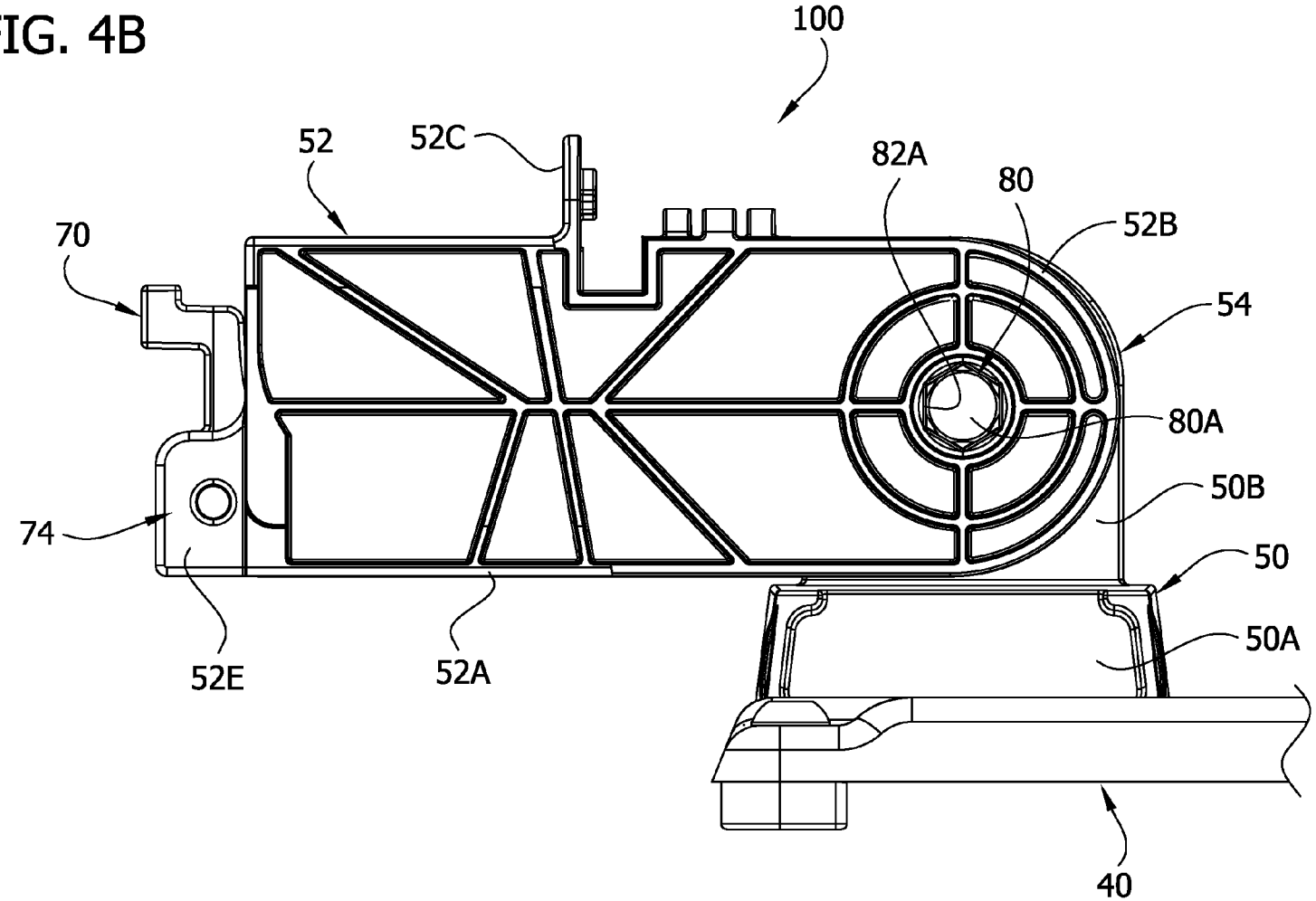
FIG. 4B is a rear elevation corresponding to the view of FIG. 4A.

Referring now to FIGS. 1, 4A, 4B, and 5, the magazine well insert member 52 may be selectively pivoted about the pivot connection 54 with respect to the base 50. In FIG. 1, the magazine well insert member 52 is shown in a slightly pivoted or off vertical position with respect to the base 50 extending slightly toward the second support 44. The magazine well insert member 52 may be pivoted in the opposite direction for mounting the lower receiver 26 in a position in which the upper receiver 24 and barrel assembly 28 may be pivoted with respect to the lower receiver (e.g., about a pivot pin of the gun) to "break open" the receiver assembly and lower the barrel assembly into engagement with the second support 44. Such a position provides access to several gun components inside the receiver assembly (e.g., bolt carrier, bolt, hammer, etc.) which may need to be disassembled, serviced, or cleaned. In FIGS. 4A and 4B, the magazine well insert member 52 is shown in a pivoted position in which the longitudinal axis of the insert member is about parallel with the platform 40. It will be understood the magazine well insert member 52 could be pivoted in the opposite direction about 180 degrees. The insert member 52 may be positioned in any one of a number of pivot positions within a range of about 180 degrees.

Figure 5:
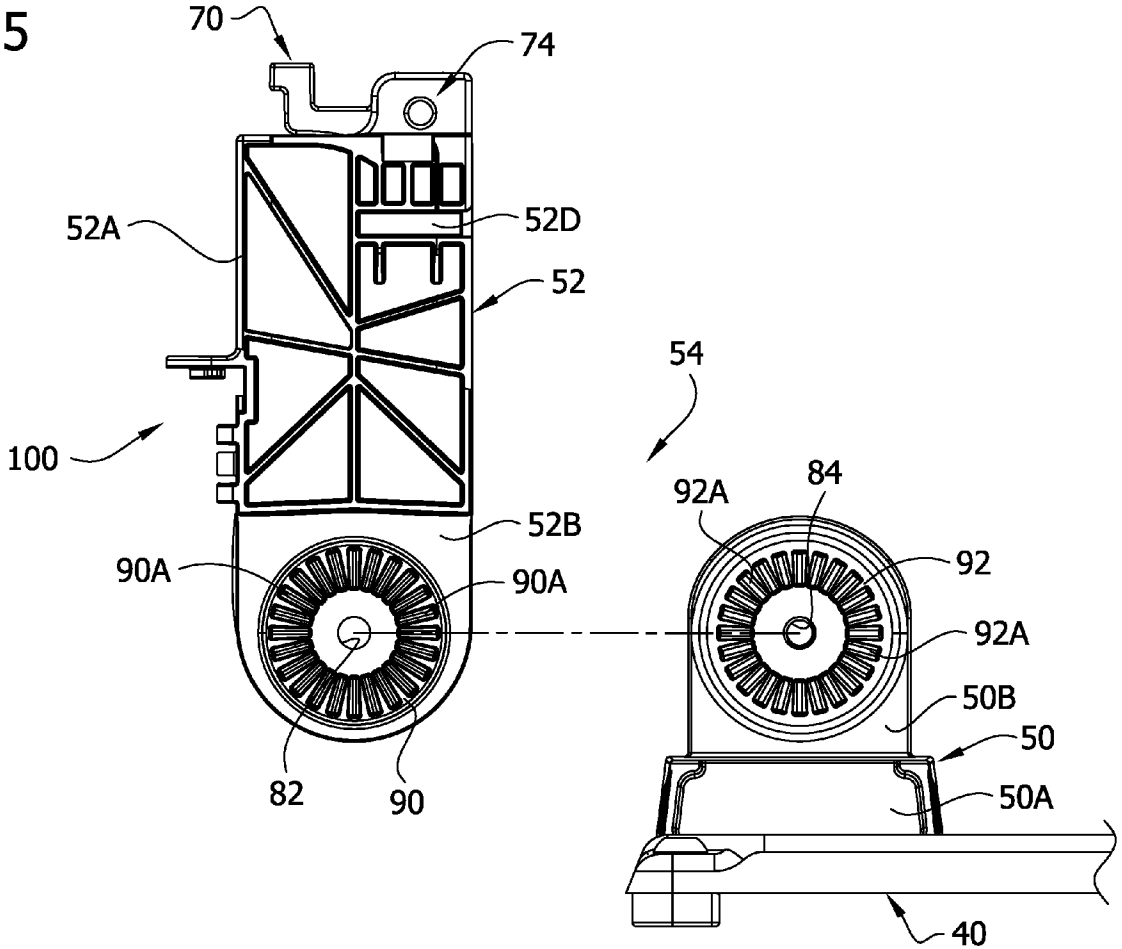
FIG. 5 is a front elevation of the first gun support, the base being exploded and rotated 180 degrees to show corresponding engagement surfaces on a rear side of the base and a front side of the magazine well insert member.

Components of the pivot connection 54 are shown in further detail in FIG. 5. The pivot connection 54 includes the pivot connection members 50B, 52B of the base 50 and magazine well insert member 52. The pivot connection 54 also includes a bolt 80 (FIG. 4B) which defines a pivot axis of the pivot connection. When the support 42 is assembled, the bolt 80 extends through an aperture 82 (FIG. 5) in the pivot connection member 52B of the insert member 52, and a head 80A of the bolt is received in a recess 82A in the insert member. As shown in FIG. 4B, the recess 82A has a size and shape corresponding to the size and shape of the bolt head 80A for preventing rotation of the bolt 80 about its longitudinal axis. The bolt 80 extends through an aperture 84 (FIG. 5) in the pivot connection member 50B of the base 50, and a knob 86 (FIG. 4A) is threaded over the distal end of the bolt. Rotation of the knob 86 on the bolt 80 in a first direction (clockwise) causes annular engagement surfaces 90, 92 of the pivot connection members 52B, 50B around the apertures 82, 84 to engage each other with increasing force. Friction between the engagement surfaces 90, 92 hinders pivoting movement of the insert member 52 about the pivot connection 54. Rotation of the knob 86 in a second direction (counterclockwise) reduces the friction between the engagement surfaces 90, 92 and permits pivoting of the insert member 52 for selective positioning of the insert member.

In the illustrated embodiment, as shown in FIG. 5, the engagement surfaces 90, 92 of the pivot connection 54 include respective openings 90A and protrusions 92A for enhancing engagement between the engagement surfaces. The openings 90A and protrusions 92A have corresponding oblong or rectangular shapes and are positioned in a symmetrical pattern and extend radially outward around the apertures 82, 84 in their respective pivot connection members 52B, 50B. The openings 90A and protrusions 92A define a number of predetermined orientations of the insert member 52 with respect to the base 50 providing for indexed positioning of the magazine well insert member 52 with respect to the base 50. Reception of the protrusions 92A in the openings 90A and rotation of the knob 86 in the first direction onto the bolt 80 "locks" the insert member 52 in a predetermined orientation or pivot position with respect to the base 50. Accordingly, the insert member 52 may be securely held in a desired position with respect to the base 50. Other types of pivot connections may be used without departing from the scope of the present invention.

Figure 6:
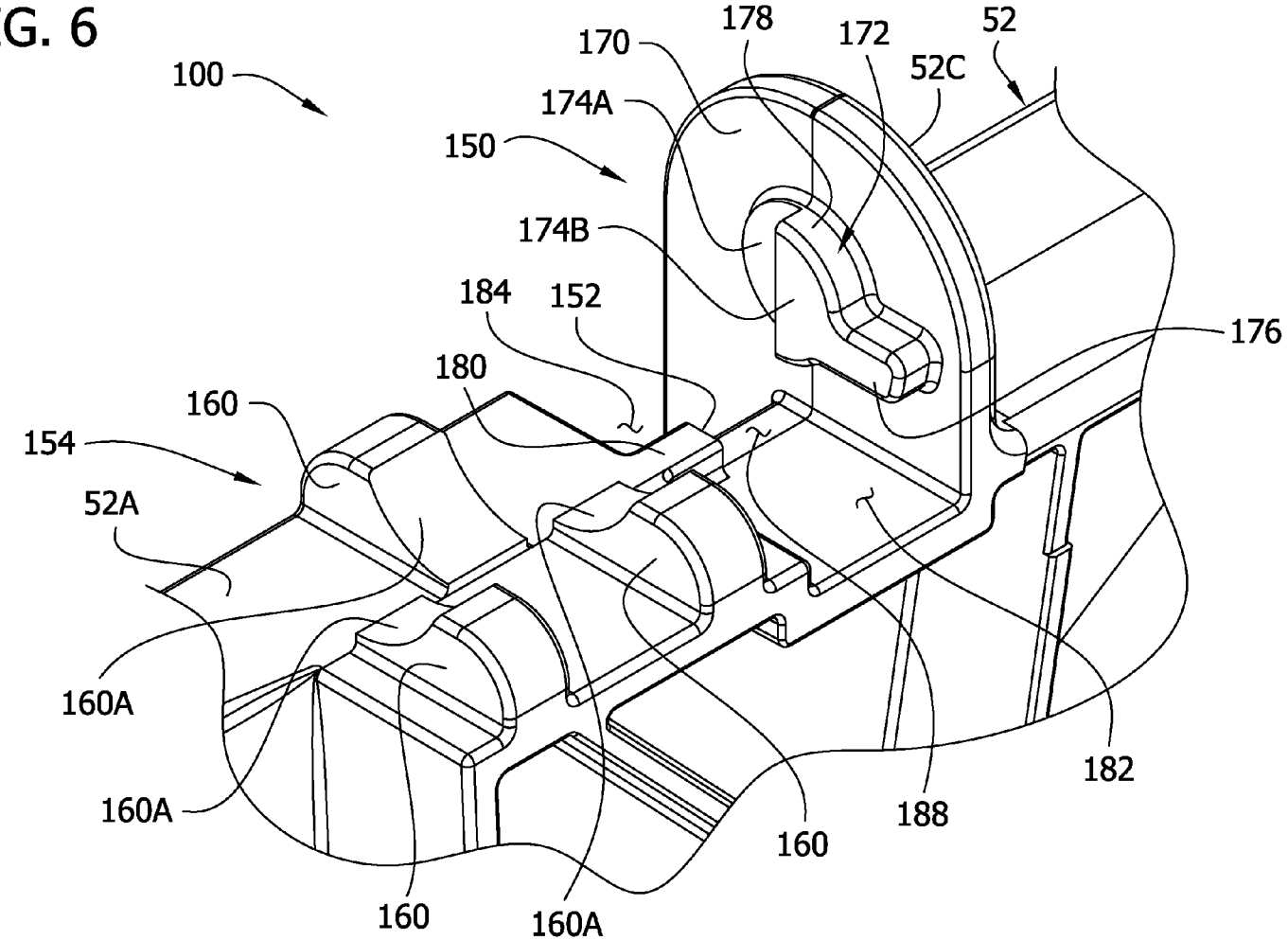
FIG. 6 is an enlarged, fragmentary perspective of a bolt support device of the first gun support.
Figure 7:
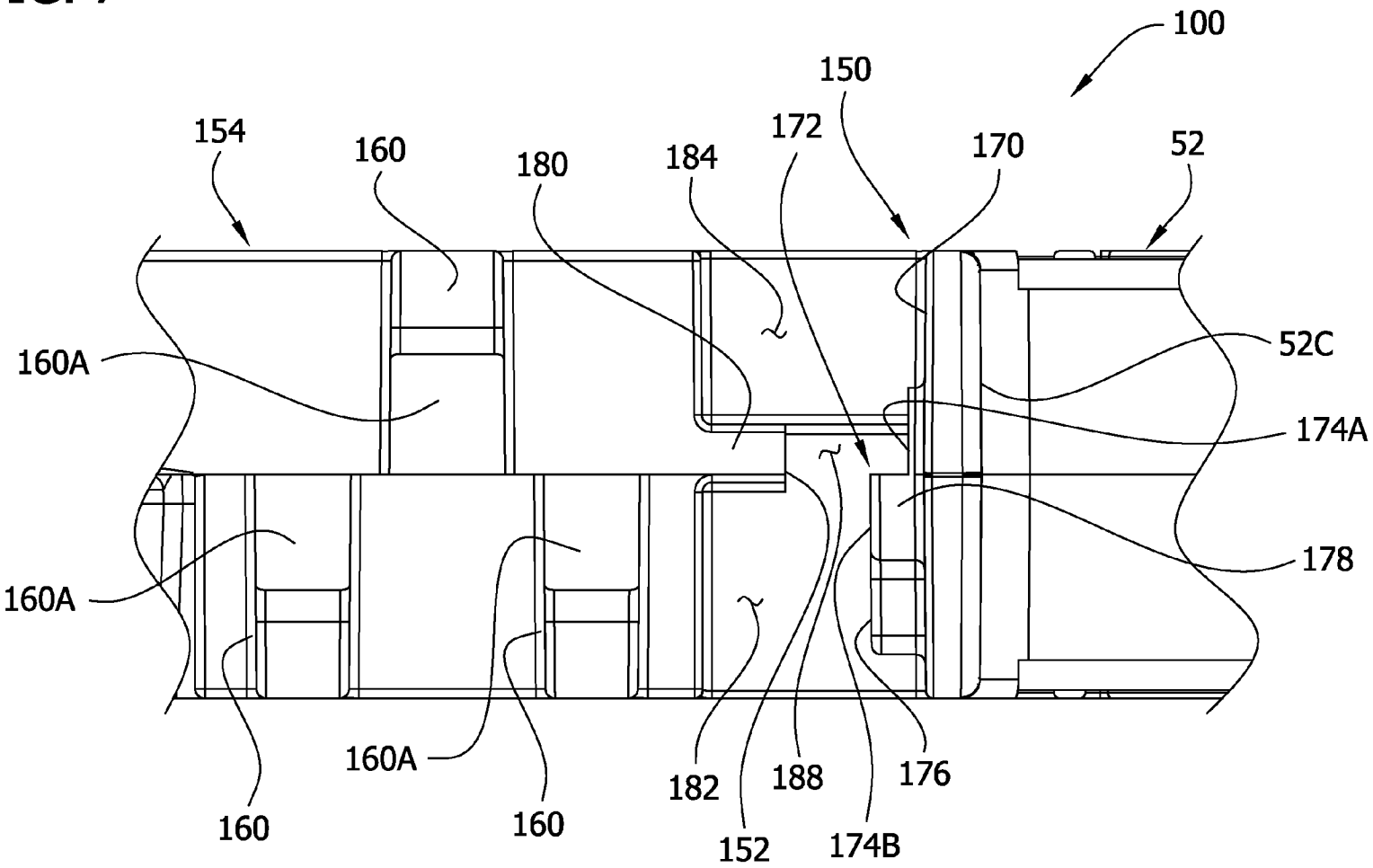
FIG. 7 is a plan view of the bolt support device of FIG. 6.
Figure 9A:
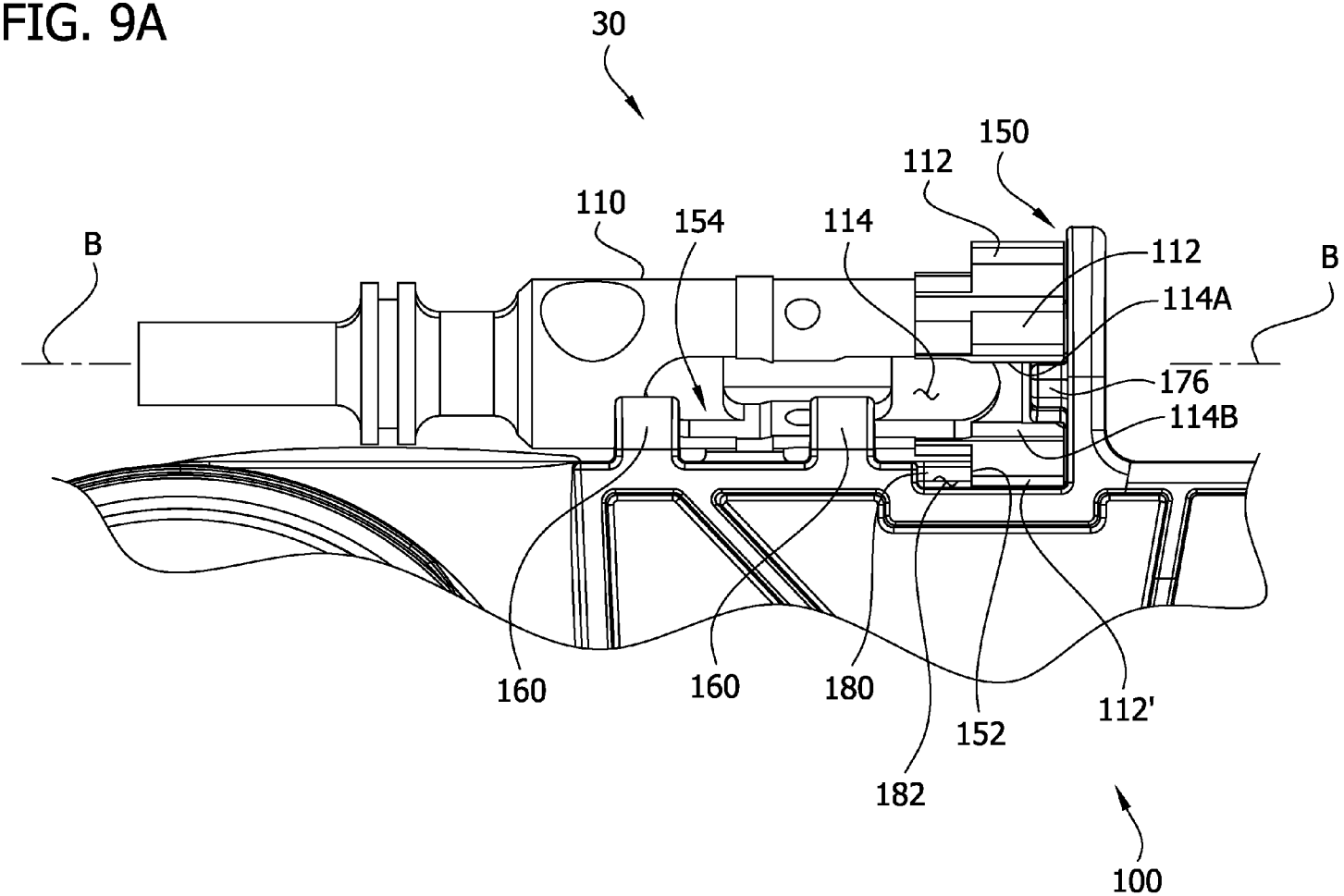
FIG. 9A is a front elevation of the bolt and a fragmentary portion of the magazine well insert member showing the bolt support device, the bolt being partially mounted on the bolt support device.
Figure 9B:
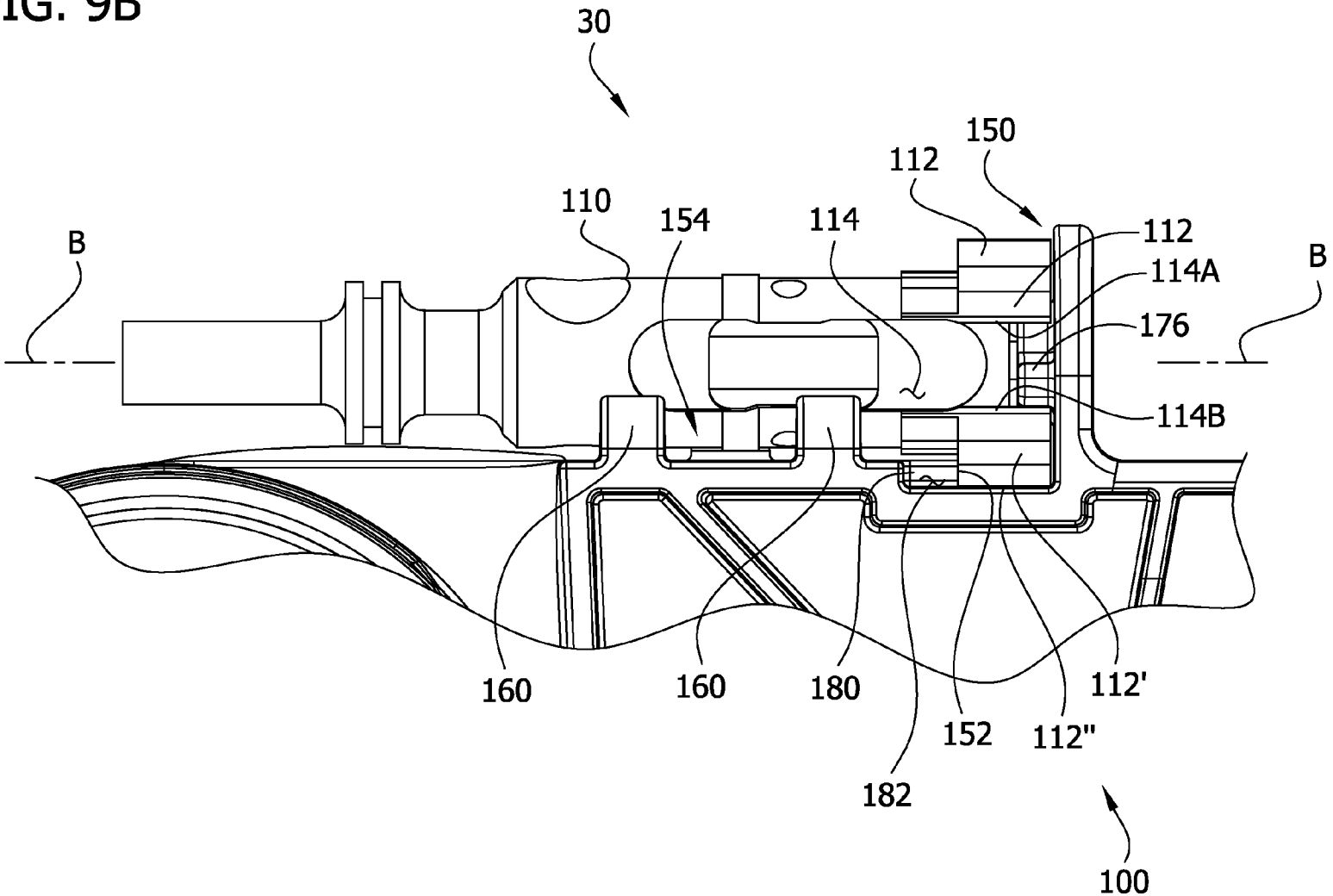
FIG. 9B is a view similar to FIG. 9A but the bolt being shown rotated into a fully mounted position on the bolt support device.

Referring to FIGS. 6 and 7, in another aspect of the present invention, the first support includes a bolt support device generally indicated by the reference number 100. The bolt support device 100 is configured for mounting the bolt 30 for securely holding it for assembling, servicing, and/or cleaning the bolt (see FIG. 9B). Desirably, the bolt support device 100 holds the bolt 30 against axial and/or transverse movement. The bolt support device 100 may be provided in locations on the vise 10 other than the first support 42, as part of a different apparatus, or as a free-standing device, without departing from the scope of the present invention. However, it will be appreciated that providing the bolt support device 100 on the pivotable magazine well insert member 52 permits selective positioning of the bolt support device in different orientations for supporting the bolt 30 mounted on the device in a desired orientation. For example, it may be desirable to mount the bolt 30 in a horizontal orientation on the bolt support device 100 positioned as shown in FIG. 9B.

Figure 8:
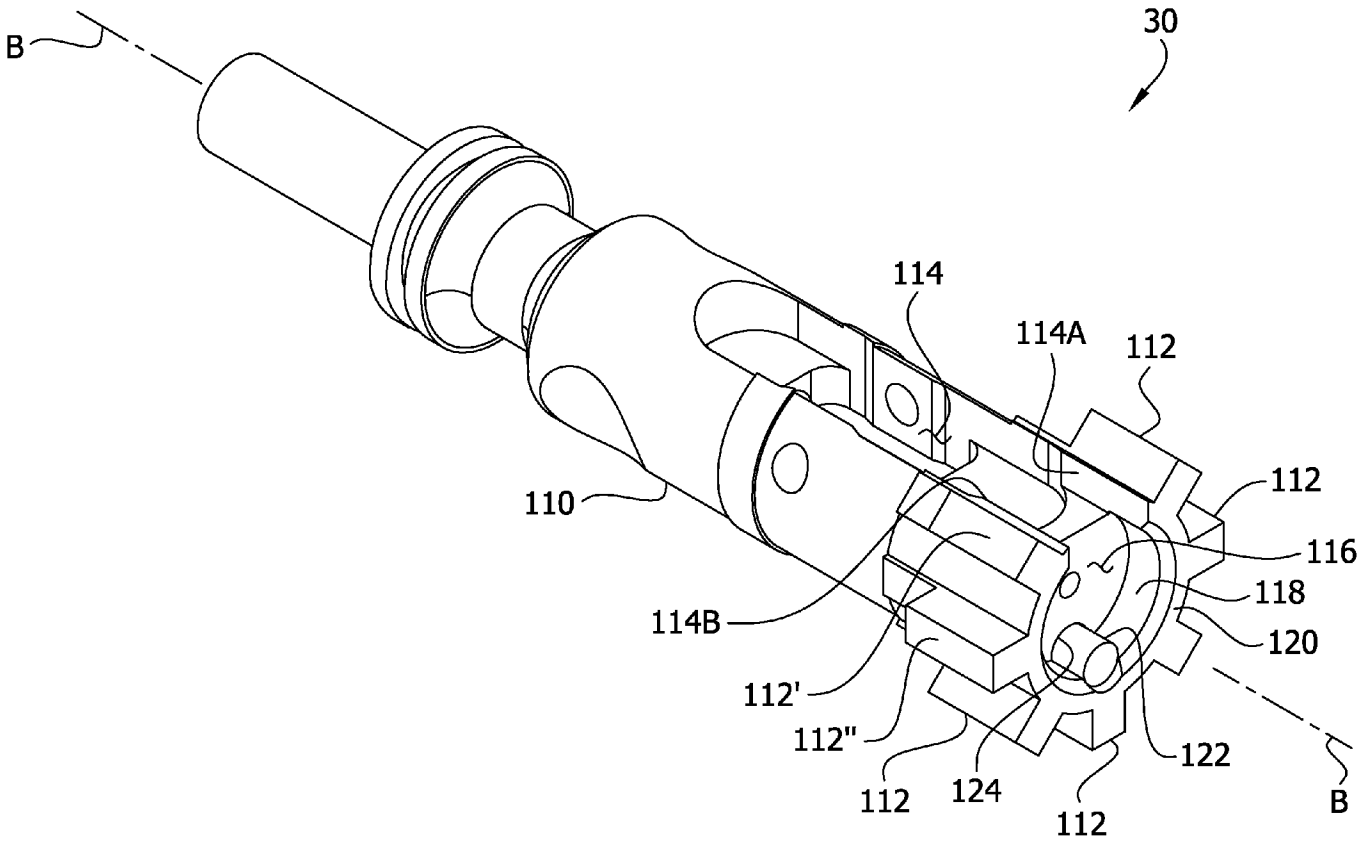
FIG. 8 is a perspective of a bolt of the gun.
Figure 10A:
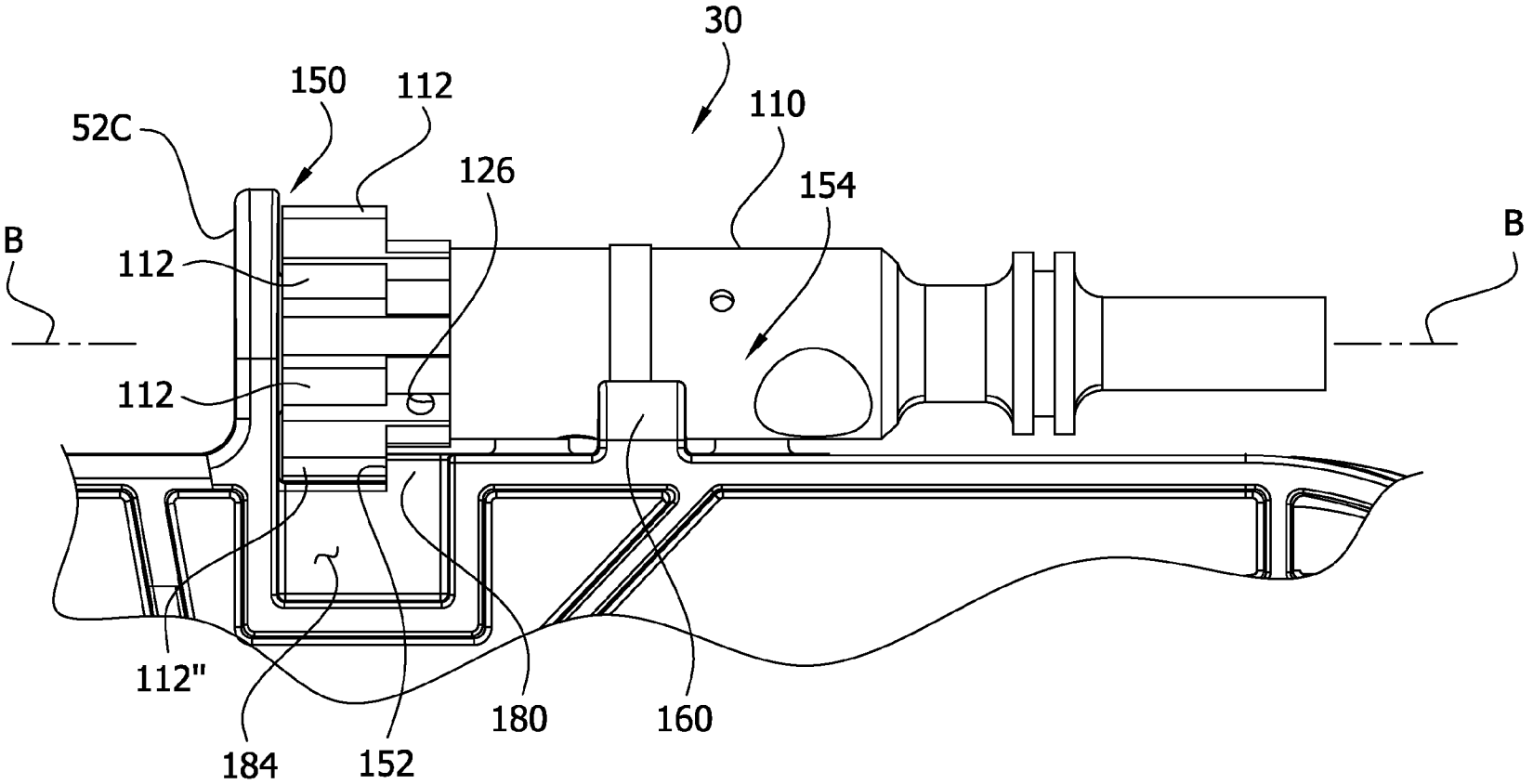
FIG. 10A is a rear elevation corresponding to the front elevation of FIG. 9A of the bolt partially mounted on the bolt support device.
Figure 10B:
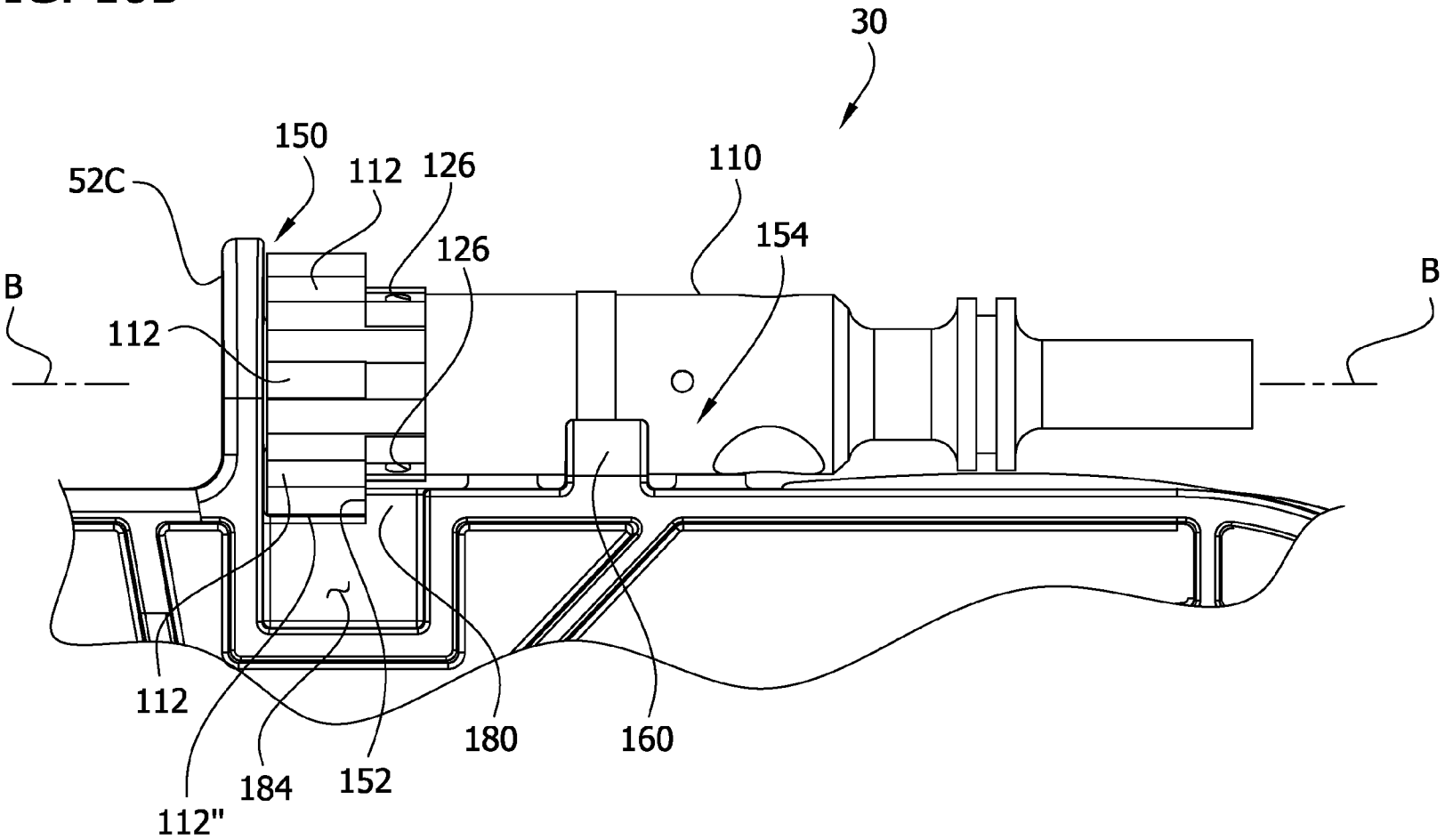
FIG. 10B is a rear elevation corresponding to the front elevation of FIG. 9B of the bolt fully mounted on the bolt support device.

Referring to FIG. 8, the bolt 30 includes a main body 110, front and rear ends, a length extending between the ends, and a longitudinal axis B. The front end of the bolt may be referred to as the face of the bolt or the bolt face. The main body 110 of the bolt 30 includes a generally cylindrical outer surface. The outer surface includes lugs 112 extending radially outward from the longitudinal axis B. The lugs 112 are positioned adjacent the front end of the bolt and form a part of the face of the bolt. The lugs each include opposite end walls extending generally transversely with respect to the longitudinal axis of the bolt, opposite side walls extending generally parallel with the longitudinal axis of the bolt, and a radially outward facing outer wall. The main body 110 includes an extractor recess 114 which has first and second side walls 114A, 114B and a length extending along the length of the bolt 30. It will be understood the bolt 30 is shown in a partially disassembled state, and that the extractor recess 114 is adapted for receiving an extractor and extractor spring (not shown) which are held in the extractor recess by an extractor pin receivable in an extractor pin opening extending transversely through the bolt. The extractor recess 114 opens out of not only the cylindrical outer surface of the main body 110 but also out of the face of the bolt 30. The bolt face includes a cylindrical cavity 116 having an annular radially inward facing side wall 118 and includes an annular forward facing end wall 120. The bolt face also includes a distal end of an ejector 122 which extends from of an ejector opening 124 in the main body 110 out into the cylindrical cavity 116. It will be understood that the proximal end of the ejector 122 is supported by an ejector spring (not shown) inside the ejector opening 124 such that the ejector is resiliently biased out of the ejector opening, and that the ejector is maintained in the ejector opening by an ejector pin (not shown) extending transversely through the bolt 30 in an ejector pin opening 126 (FIGS. 10A and 10B). The ejector 122 is displaceable into the ejector opening 124 by application of force on the distal end of the ejector at the face of the bolt. The bolt 30 is shown by way of example and not limitation. Other types of bolts may be used without departing from the scope of the present invention.

Referring again to FIGS. 6 and 7, the bolt support device 100 comprises a mount adapted for securely holding the bolt 30 against various types of movement. The bolt support device 100 includes a bolt face engagement surface 150, a lug end engagement surface 152, and a main body engagement surface 154. One or more of these engagement surfaces 150, 152, 154 may be used for holding the bolt 30 against movement. As will become apparent, the bolt 30 may be mounted on the bolt support device 100 by engaging the face of the bolt with the bolt face engagement surface 150, engaging the main body 110 of the bolt with the main body engagement surface 154, and rotating the bolt about its longitudinal axis B to bring an end of a lug 112 into engagement with the lug end engagement surface 152.

The main body engagement surface 154 includes a cradle formed by the left side of the body 52A of the magazine well insert member 52 and three braces 160 extending outward from the left side of the body. The braces 160 each include an arcuate side wall section 160A positioned for collectively cradling a corresponding portion of the cylindrical outer surface of the main body 110 of the bolt 30. As will be appreciated, the main body engagement surface 154 holds the main body 110 of the bolt 30 from transverse movement with respect to the longitudinal axis B. The main body engagement surface 154 is oriented generally perpendicular to the bolt face engagement surface 150.

The bolt face engagement surface 150 includes a generally planar surface 170 and a key-like protrusion 172 extending outward from the generally planar surface. In the illustrated embodiment, the bolt face engagement surface 150 is provided on a bottom side of the magazine well rest 52C, but it may be provided separately from the magazine well rest without departing from the scope of the present invention. The key-like protrusion 172 includes a cylindrical portion having an axially recessed section 174A and an axially protruding section 174B, and the key-like protrusion includes a tooth 176 extending radially outward from the protruding section 174B. The cylindrical portion is sized and shaped for reception in the cylindrical cavity 116 of the bolt face. The recessed section 174A has reduced thickness and is adapted for engaging the distal end of the ejector 122. The tooth 176 extends from the protruding section 174B. The cylindrical portion has a radially outwardly facing side wall 178 (including side wall sections of the truncated and non-truncated sections 174A, 174B) adapted for engaging the radially inwardly facing annular side wall 118 of the cylindrical cavity 116 of the bolt face. Engagement of the radially outwardly facing side wall 178 of the cylindrical portion with the radially inward facing annular side wall 118 of the bolt face assists in preventing transverse movement of the bolt 30 with respect to the longitudinal axis B of the bolt. The tooth 176 is positioned for reception in the end of the extractor recess 114 where it opens out of the bolt face. As described in further detail below, the tooth 176 limits rotation of the bolt 30 about the longitudinal axis B of the bolt while the bolt face is in engagement with the bolt face engagement surface 150.

The lug end engagement surface 152 is formed by a tab 180 extending from the main body engagement surface 154 toward the bolt face engagement surface 150. A relatively shallow recess 182 is provided on a first side of the tab 180 between the main body engagement surface 154 and the bolt face engagement surface 150. A deeper recess 184 is provided on a second side of the tab 180. As will become apparent, the deeper recess 184 is sized for receiving the ejector pin as it is pushed out of the ejector pin opening 126 in the bolt 30 for releasing the ejector 122 from the ejector opening 124. The lug end engagement surface 152 opposes the bolt face engagement surface 150 and defines therebetween a lug receiving space 188 having a length about the same as or slightly greater than the length of the bolt lugs 112. As described in further detail below, a lug 112 can be rotated into the lug receiving space 188 to position an end wall of the lug opposite the bolt face in engagement with the lug end engagement surface 152. Engagement of the lug 112 with the lug end engagement surface 152 prevents axial movement of the bolt 30 with respect to the longitudinal axis B of the bolt away from the bolt face engagement surface 150.

The bolt 30 can be mounted on the bolt support device 100 by engaging the bolt face with the bolt face engagement surface 150, engaging the main body 110 of the bolt with the main body engagement surface 154, and rotating the bolt 30 about its longitudinal axis B to bring a lug 112 of the bolt into engagement with the lug end engagement surface 152. This process will be described with reference to FIGS. 9A, 9B, 10A, and 10B. FIGS. 9A and 10A show the bolt face in engagement with the bolt face engagement surface 150 and the main body 110 in engagement with the main body engagement surface 154. The bolt 30 has not yet been rotated to position a lug 112 in the lug receiving space 188. In this position, first and second lugs 112', 112" are positioned on opposite sides of the lug receiving space 188 and out of register with the tab 180 defining the lug end engagement surface 152. Moreover, in this position, the tooth 176 of the bolt face engagement surface 150 engages the first side wall 114A of the extractor recess 114 at the bolt face. Desirably, engagement of the bolt face with the bolt face engagement surface 150 includes engagement of the distal end of the ejector 122 with the recessed section 174A of the cylindrical portion of the protrusion 172 of the bolt face engagement surface 150. This causes the ejector 122 to be displaced into the ejector opening 124 to compress the ejector spring, and thus causes the ejector to be resiliently biased toward the truncated section 174A. The bolt face engagement surface 150 is configured for permitting rotation of the bolt face against the bolt face engagement surface about the longitudinal axis B of the bolt 30 to position a lug 112" in the lug receiving space 188. FIGS. 9B and 10B show the bolt 30 after being rotated in the first direction (counterclockwise). Rotation of the bolt 30 about its longitudinal axis B in the first direction causes the second lug 112" to move into the lug receiving space 188 (FIGS. 6 and 7) and into register with the lug end engagement surface 152. This position of the second lug 112" can be positively determined by engagement of the second side wall 114B of the extractor recess 114 with the tooth 176 of the bolt face engagement surface 150. This engagement of the tooth 176 with the second wall 114B of the extractor recess 114 prevents over rotation of the bolt 30, which might bring the second lug 112" out of register with the lug end engagement surface 152. The lug end engagement surface 152 is sized for engaging a single lug 112 in the lug receiving space 188 (e.g., the second lug 112"). When the second lug 112" is rotated into the lug receiving space 188, the force of the ejector 122 (resulting from the compressed ejector spring) against the recessed section 174A of the bolt face engagement surface 150 causes the end of the second lug 112" opposite the bolt face to press against the lug end engagement surface 152. The compression of the ejector spring provides a tight fit of the bolt 30 between the lug end engagement surface 152 and the bolt face engagement surface 150. In this position (e.g., FIGS. 9B and 10B), the bolt is fully mounted on the bolt support device 100.

The arrangement is such that when the bolt 30 is mounted on the bolt support device 100, the bolt 30 is held against transverse movement by engagement with the main body engagement surface 154 and with the bolt face engagement surface 150, and the bolt is held against axial movement by engagement with the lug end engagement surface 152 and the bolt face engagement surface 150. The bolt 30 is held against rotational movement (e.g., rotational movement about the bolt face) by its engagement with the main body engagement surface 154, lug end engagement surface 152, and bolt face engagement surface 150. Moreover, the bolt 30 is held against rotational movement in the first direction (counterclockwise) about its longitudinal axis B by engagement of the second side wall 114B of the extractor recess 114 with the tooth 176 of the bolt face engagement surface 150. Desirably, when the bolt 30 is mounted on the bolt support device 100, the only readily permitted movement of the bolt is rotation of the bolt about its longitudinal axis B in a second direction (clockwise) opposite the first direction (counterclockwise).

While the bolt 30 is mounted on the bolt support device 100, several operations may be performed on the bolt. For example, the ejector pin may be removed for removing the ejector 122 from the bolt for servicing or cleaning the ejector and ejector spring. As shown in FIG. 10B, when the bolt 30 is mounted on the bolt support device 100, the ejector pin opening 126 is oriented such that the pin may be pushed out of the ejector pin opening into the recess 184 on the side of the tab 180 defining the lug end engagement surface 152.

To remove the bolt 30 from the bolt support device 100 the bolt is rotated in the second direction (clockwise), for example, to the position shown in FIGS. 9A and 10A. Rotation of the bolt 30 in the second direction brings the second lug 112" out of register with the lug engagement surface 152. This can be positively determined by engagement of the first side wall 114A of the extractor recess 114 with the tooth 176 of the bolt face engagement surface 150. The engagement of the first side wall 114A of the extractor recess 114 with the tooth 176 also prevents over rotation of the bolt 30 in the second direction, which might inadvertently bring the first lug 112' into register with the lug engagement surface 152 and prevent removal of the bolt from the bolt support device 100. With the second lug 112" out of register with the lug end engagement surface 152, the bolt is permitted to move axially away from the bolt face engagement surface 150 and then transversely away from the main body engagement surface 154.

It will be appreciated that the bolt support device of the present invention provides several advantages and benefits. For example, the design permits the bolt face engagement surface 150 to be fixed in position (in a predetermined position) with respect to the lug end engagement surface 152 and the main body engagement surface 154. No movement of the bolt face engagement surface 150 or other engagement surfaces 152, 154 is required for mounting the bolt 30 on the bolt support device 100. In the illustrated embodiment, the bolt support device 100 has no moving parts. Accordingly, the components of the bolt support device 100 may be formed together or as a single piece (e.g., formed together in a molding operation), such as in the same molding operation in which the body 52A of the magazine well insert member 52 is formed. This reduces manufacturing costs and enables the bolt support device to be formed as an integral or fixed part of another apparatus, such as a part of the first support 42.

Figure 11:
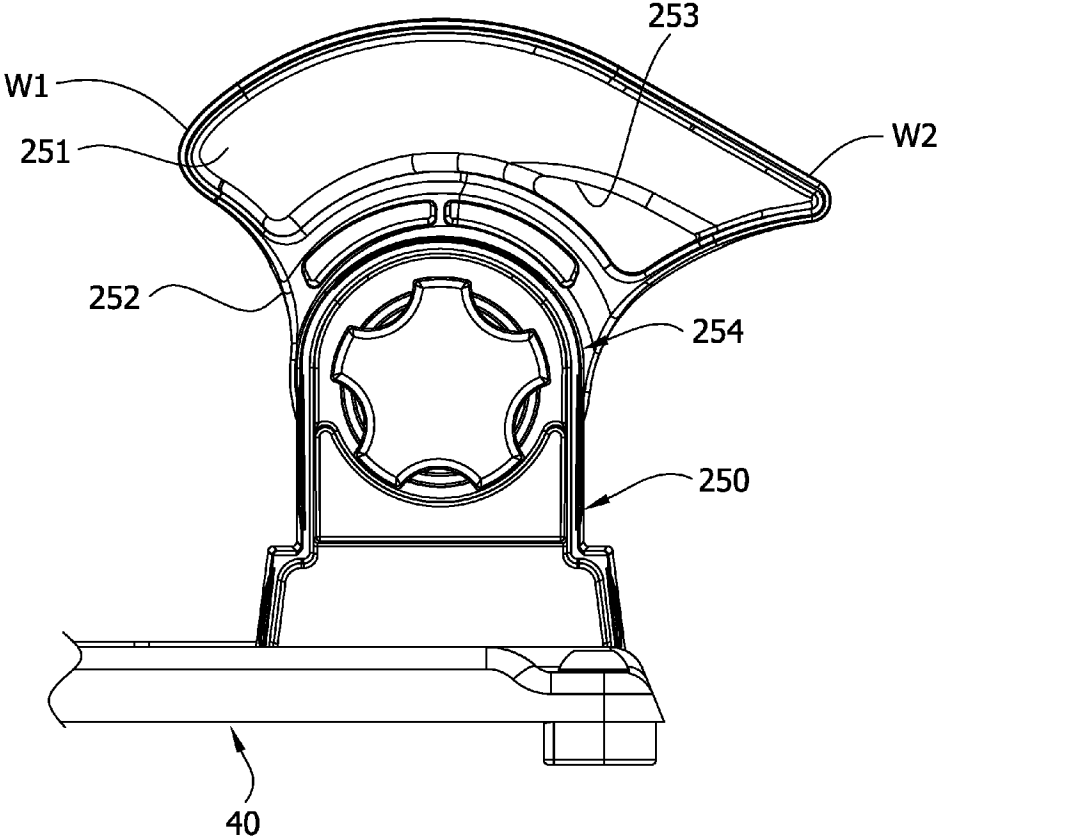
FIG. 11 is a fragmentary, rear elevation of the gun vise of FIG. 1 including the second gun support.
Figure 12:
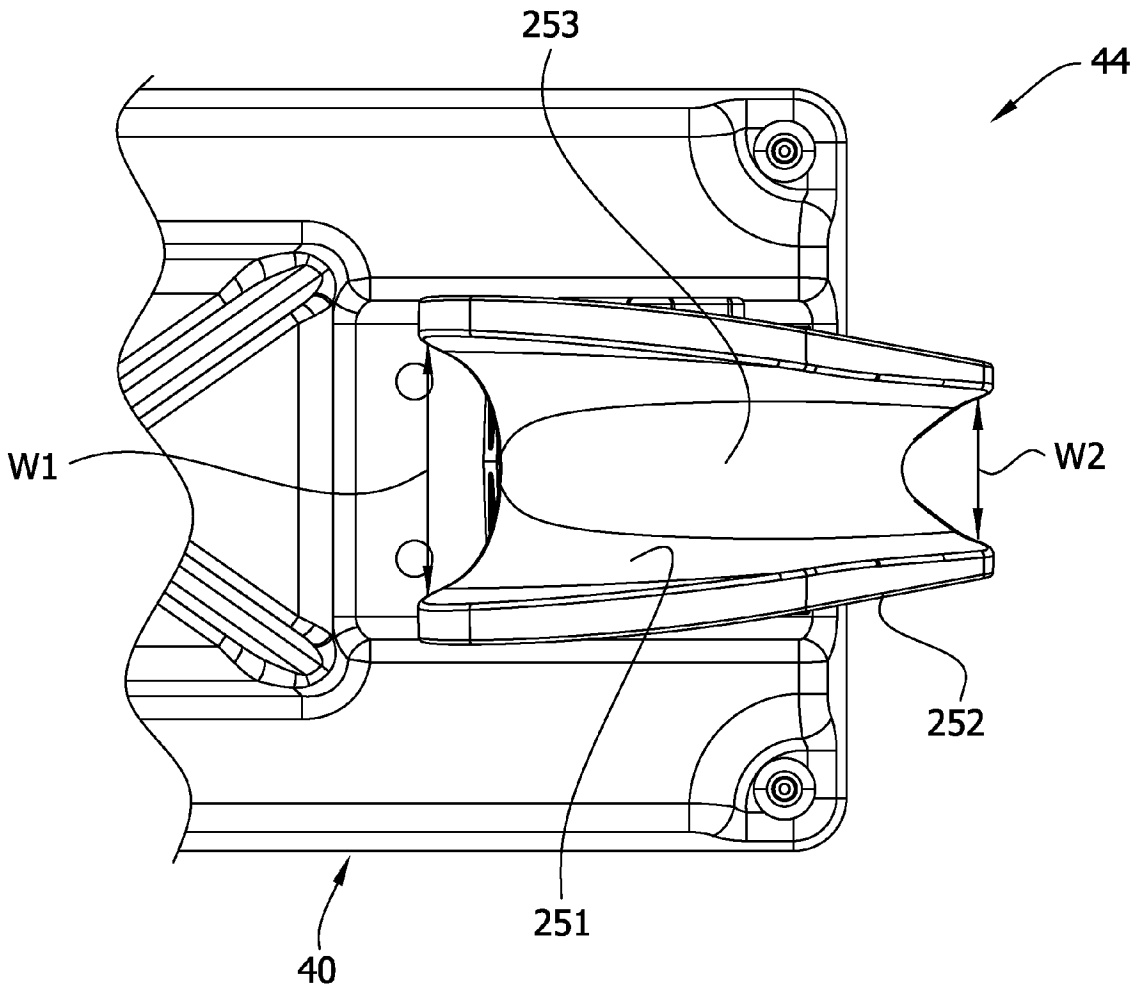
FIG. 12 is a top plan view of the fragmentary portion of the gun vise including the second gun support of FIG. 11.

Referring to FIGS. 11 and 12, the second support 44 is adapted for supporting a portion of the barrel assembly 28 of the gun 20. The second support 44 includes a base 250 which may be identical in construction and connection to the platform 40 as the base 50 of the first support 42. The second support 44 also includes a support body 252 including a support channel 251 having a width and a depth sized for receiving a portion of the barrel assembly 28. The channel 251 has a first width W1 adjacent a first end and has a second width W2 lesser than the first width adjacent a second end. The width of the channel tapers from the first width W1 to the second width W2 along the length of the channel 251 between the first and second ends. The support body 252 is pivotally connected to the base 250 by a pivot connection 254, which may have a construction essentially the same as the pivot connection 54 of the first support. The channel 251 extends along its length in an arcuate path generally about the pivot connection 254. In other words, the channel has a spine 253 (e.g., bottom between opposite side walls) which has an arcuate shape along its length, and the pivot connection is located on the concave side of the arcuate shape of the spine. The arrangement is such that the second support 44 is adjustable for securely supporting portions of the barrel assembly 28 having different widths. Pivoting of the support channel 251 about the pivot connection 254 moves the first and second widths W1, W2 of the support channel to different radial positions with respect to the pivot connection. For example, if a portion of the handguard or forend 28B is to be supported in the support channel 251, the support body 252 may be pivoted about the pivot connection 254 such that the first end of the channel having the greater width W1 or a portion of the channel adjacent the first end is positioned for receiving the forend. On the other hand, if a portion of the barrel 28A is to be supported in the support channel 251, the support body 252 may be pivoted about the pivot connection 254 such that the second end of the channel having the lesser width W1 or a portion adjacent the second end is positioned for receiving the barrel 28A. It will be appreciated that the orientation of the support body 252 with respect to the base 250 may be adjusted as desired to position a portion of the channel 251 having a width corresponding to a width of a component to be supported in the channel for receiving that component.

Figure 13:
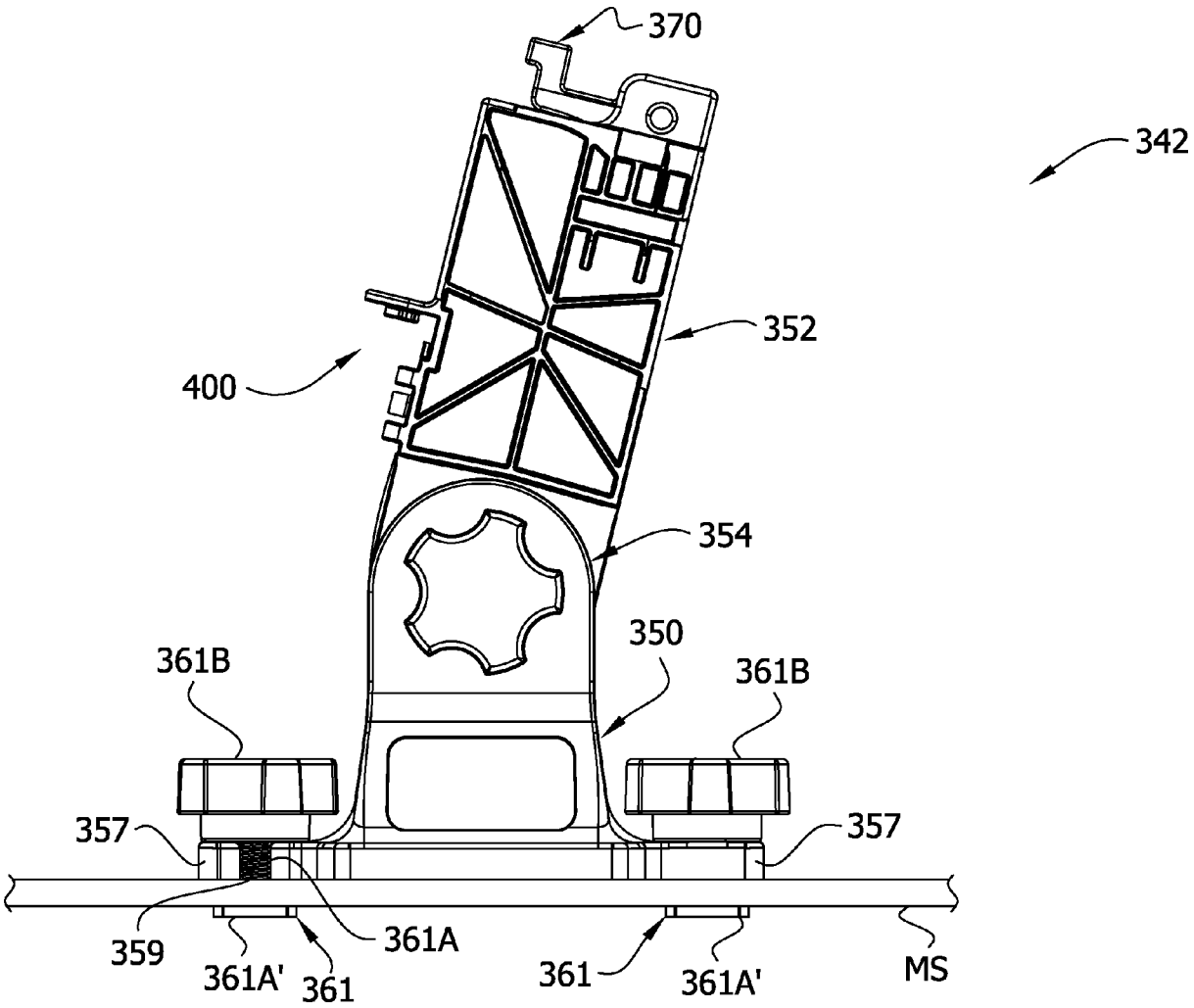
FIG. 13 is a front elevation of a second embodiment of a gun support similar to the gun support of FIG. 2 mounted to a mounting surface.

Referring to FIG. 13, a second embodiment of a support of the present invention is designated generally by the reference number 342. The support is identical to and functions the same as the first support 42 except as otherwise noted hereafter. Like parts are designated by like reference numbers, plus 300. For example, the support 342 includes a base 350 and a magazine well insert member 352. The insert member 352 is connected to the base 350 by a pivot connection 354. The insert member 352 includes a hammer stop 370 and a bolt support device 400. In this embodiment, the base 350 is mounted differently. The base 350 includes shoulders 357 extending outward from a lower end of the base body 350A. The shoulders 357 include openings 359 (only one being shown) which extend vertically through the shoulders for receiving fasteners 361. The openings 359 also open out of sides of the shoulders 357. In the illustrated embodiment, the opening 359 of the left shoulder 357 opens out of the side of the shoulder facing into the page, and the opening of the right shoulder 357 opens out of the side of the shoulder facing out of the page. The fasteners 361 each include a threaded bolt 361A and a knob 361B. When the knobs 361B are in threaded engagement with distal ends of the bolts 361A, rotation of the knobs in a first direction (clockwise) draws heads 361A' of the bolts toward the shoulders 357 for tightening the heads and shoulders against opposite sides of a mounting surface MS. For example, the heads 361A' of the bolts 361A may have a generally flat, oblong shape which is suitable for reception in a track in a platform of a vise for mounting the support to the platform. Alternatively, the bolts may be extended through openings in any suitable mounting surface MS (e.g., tabletop, countertop, etc.) for mounting the support to that surface. The versatile mounting of the support 342 makes it usable in a variety of circumstances and settings. For example, the support 342 may be mounted on a vise, bench top, or other surface for typical shop use and be removed and transported to an off-site location for use there with any mounting surface which includes suitable openings or holes for the bolts 361A or which can be modified (e.g., drilled) to provide such holes. It will be understood that the support 342 functions in use essentially the same as the first support described above and may or may not be used in conjunction with another support such as the second support 44 described above.

Having described the invention in detail, it will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A vise for a gun including at least one of a magazine well, a barrel assembly, a hammer, and a bolt, the vise comprising:

a platform;

a first gun support connected to the platform, the gun support including a magazine well insert member receivable in the magazine well of the gun for supporting the gun, the magazine well insert member being connected to the platform via a pivot connection for selective pivoting movement of the insert member with respect to the platform for supporting the gun on the magazine well insert member in a desired position.

2. A vise as set forth in claim 1 further comprising a second gun support connected to the platform, the second gun support being spaced from the first gun support and being adapted for supporting a portion of the barrel assembly of the gun.

3. A vise as set forth in claim 1 wherein the pivot connection includes engagement surfaces adapted for defining predetermined pivot positions of the magazine well insert member with respect to the platform.

4. A vise as set forth in claim 3 wherein the engagement surfaces include corresponding protrusions and openings, the protrusions being receivable in the openings for defining the predetermined pivot positions of the magazine well insert member with respect to the platform.

5. A vise as set forth in claim 1 wherein the magazine well insert member includes a hammer stop.

6. A vise as set forth in claim 1 further comprising a bolt support device adapted for mounting the bolt of the gun on the vise.

7. A support for a gun including at least one of a magazine well, a hammer, and a bolt, the support comprising:

a base adapted for mounting to a support surface;

a magazine well insert member receivable in the magazine well of the gun for supporting the gun; and a pivot connection pivotally connecting the magazine well insert member to the base for permitting selective pivoting movement of the insert member with respect to the base about the pivot connection.

8. A support as set forth in claim 7 wherein the pivot connection is constructed for indexing between predetermined pivot positions of the magazine well insert member with respect to the base.

9. A support as set forth in claim 8 wherein the pivot connection comprises engagement surfaces including corresponding protrusions and openings, the protrusions being receivable in the openings for defining the predetermined pivot positions of the magazine well insert member with respect to the base.

10. A support as set forth in claim 7 further comprising a bolt support device on the magazine well insert member.

11. A support as set forth in clam 7 wherein the bolt support device is formed in a molding operation for forming a body of the magazine well insert member such that the bolt support device is formed as one piece with the body of the magazine well insert member.

12. A support for a gun including a magazine well and a hammer, the support including:

a base adapted for mounting to a support surface; and a magazine well insert member connected to the base, the magazine well insert member including a body receivable in the magazine well of the gun for supporting the gun, and the magazine well insert including a hammer stop to engage the hammer.

13. A support as set forth in claim 12 wherein the body of the magazine well insert member and the hammer stop comprise different materials.

14. A support as set forth in claim 13 wherein the hammer stop comprises a compressible, resilient material.

15. A support as set forth in claim 12 wherein the hammer stop comprises a first portion connected to the body of the magazine well insert member and a second portion extending laterally with respect to the first portion.

16. A support as set forth in claim 12 wherein the hammer stop is mounted on the body of the magazine well insert member for selective movement of the hammer stop between a stowed position and a deployed position in which the hammer stop is positioned for engaging the hammer of the gun.

* * * * *